US011607577B2

(12) United States Patent
Muehl

(10) Patent No.: US 11,607,577 B2
(45) Date of Patent: Mar. 21, 2023

(54) LINEAR BEARINGS AND ALIGNMENT METHOD FOR WEIGHT LIFTING APPARATUS

(71) Applicant: WHITEROCK EXERCISE, INC., Waukesha, WI (US)

(72) Inventor: Jeffrey Muehl, Waukesha, WI (US)

(73) Assignee: Whiterock Exercise, Inc., Waukesha, WI (US)

( * ) Notice: Subject to any disclaimer, the term of this patent is extended or adjusted under 35 U.S.C. 154(b) by 49 days.

(21) Appl. No.: 17/491,758

(22) Filed: Oct. 1, 2021

(65) Prior Publication Data

US 2022/0023703 A1 Jan. 27, 2022

Related U.S. Application Data

(60) Division of application No. 16/796,411, filed on Feb. 20, 2020, now Pat. No. 11,253,740, which is a division of application No. 16/131,498, filed on Sep. 14, 2018, now abandoned, which is a division of application No. 15/477,688, filed on Apr. 3, 2017, now Pat. No. 10,201,726, which is a division of application No. 14/955,792, filed on Dec. 1, 2015, now Pat. No. 9,795,824, which is a continuation of application No. 14/733,287, filed on Jun. 8, 2015, now Pat. No. 9,211,435, which is a division of application No. 13/773,274, filed on Feb. 21, 2013, now Pat. No. 9,079,068.

(60) Provisional application No. 61/601,368, filed on Feb. 21, 2012.

(51) Int. Cl.
*A63B 21/078* (2006.01)
*A63B 21/062* (2006.01)

(52) U.S. Cl.
CPC ..... *A63B 21/078* (2013.01); *A63B 21/062* (2013.01); *A63B 21/063* (2015.10); *A63B 21/0624* (2015.10); *A63B 21/0628* (2015.10)

(58) Field of Classification Search
CPC . A63B 21/078; A63B 21/0624; A63B 21/063; A63B 21/0628; A63B 21/062; A63B 21/4035; A63B 21/154; A63B 2210/50; A63B 21/4029; A63B 21/00069; A63B 21/00181; A63B 21/16; A63B 2225/10; A63B 21/06; A63B 21/15
See application file for complete search history.

(56) References Cited

U.S. PATENT DOCUMENTS

| | | | |
|---|---|---|---|
| 4,010,947 | A | 3/1977 | Lambert, Sr. |
| 4,208,049 | A | 6/1980 | Wilson |
| 4,601,466 | A | 7/1986 | Lais |
| 4,627,615 | A | 12/1986 | Nurkowski |
| 4,834,365 | A | 5/1989 | Jones |
| 5,178,597 | A | 1/1993 | Jones |

(Continued)

OTHER PUBLICATIONS

International Search Report and Written Opinion of International Searching Authority dated Apr. 18, 2013 in International Application No. PCT/US2013/027149.

(Continued)

*Primary Examiner* — Andrew S Lo
(74) *Attorney, Agent, or Firm* — Ryan Kromholz & Manion, S.C.

(57) ABSTRACT

A weight system having at least one weight stack moveable in a vertical direction on a lift rod, and a bearing block for housing a linear bearing. The invention further includes a method and apparatus for aligning the linear bearing.

2 Claims, 20 Drawing Sheets

(56) References Cited

U.S. PATENT DOCUMENTS

| | | | |
|---|---|---|---|
| 5,256,125 | A | 10/1993 | Jones |
| 5,374,229 | A | 12/1994 | Sencil |
| 5,484,365 | A | 1/1996 | Jones et al. |
| 5,575,743 | A | 11/1996 | Jones et al. |
| 5,667,463 | A | 9/1997 | Jones |
| 5,776,040 | A | 7/1998 | Webb et al. |
| 5,928,112 | A | 7/1999 | Jones et al. |
| 6,004,246 | A | 12/1999 | Sencil |
| 6,015,372 | A | 1/2000 | Steffee et al. |
| D431,059 | S | 9/2000 | Webber et al. |
| 6,117,049 | A | 9/2000 | Lowe |
| 6,193,635 | B1 | 2/2001 | Webber et al. |
| 6,206,810 | B1 | 3/2001 | Alessandri |
| 6,575,882 | B2 | 6/2003 | Chen |
| 6,629,910 | B1 | 10/2003 | Krull |
| 7,413,532 | B1 | 8/2008 | Monsrud et al. |
| 7,435,206 | B1 | 10/2008 | Nalley |
| 7,537,550 | B1 | 5/2009 | Krull |
| 7,540,832 | B2 | 6/2009 | Krull |
| 7,608,021 | B1 | 10/2009 | Nalley |
| 7,608,023 | B2 | 10/2009 | Casagrande |
| 7,628,736 | B2 | 12/2009 | Vandyke |
| 7,708,672 | B2 | 5/2010 | Gibson et al. |
| 7,758,478 | B2 | 7/2010 | Golesh et al. |
| 7,938,762 | B2 | 5/2011 | Nishimura |
| 8,187,155 | B2 | 5/2012 | Oooka |
| 8,511,896 | B2 | 8/2013 | Shirai et al. |
| 2002/0037792 | A1 | 3/2002 | Smith |
| 2002/0119870 | A1 | 8/2002 | Chen |
| 2002/0198087 | A1 | 12/2002 | Mitchell et al. |
| 2003/0017918 | A1 | 1/2003 | Webb et al. |
| 2005/0245369 | A1 | 11/2005 | Vigiano |
| 2006/0217245 | A1 | 9/2006 | Golesh et al. |
| 2008/0039295 | A1 | 2/2008 | Steinmetz |
| 2008/0161170 | A1 | 7/2008 | Lumpee |
| 2008/0236312 | A1 | 10/2008 | Keller et al. |
| 2008/0242520 | A1 | 10/2008 | Hubbard |
| 2009/0227432 | A1 | 9/2009 | Pacheco |
| 2009/0279814 | A1 | 11/2009 | Yang |
| 2011/0028282 | A1 | 2/2011 | Sbragia |
| 2011/0044568 | A1 | 2/2011 | Vedsted et al. |
| 2011/0195823 | A1 | 8/2011 | Lee |
| 2011/0195824 | A1 | 8/2011 | Shen |
| 2011/0287896 | A1 | 11/2011 | Kim et al. |
| 2012/0083392 | A1 | 4/2012 | Taranto |
| 2012/0100961 | A1 | 4/2012 | Nishimura |
| 2012/0135842 | A1 | 5/2012 | Verkaik |
| 2012/0208679 | A1 | 8/2012 | Webb |
| 2012/0322629 | A1 | 12/2012 | Webb |

OTHER PUBLICATIONS

International Preliminary Report on Patentability dated Jan. 22, 2014 in International Application No. PCT/US2013/027149.

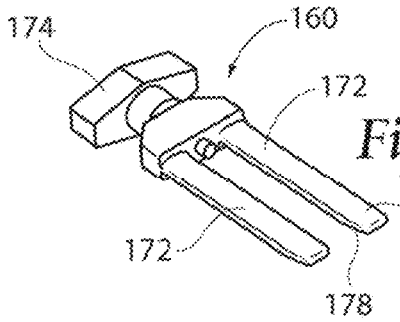
Fig. 38
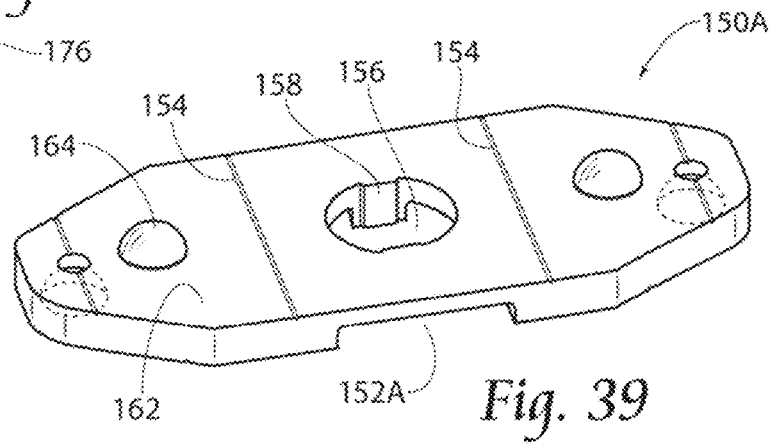
Fig. 39
Fig. 40
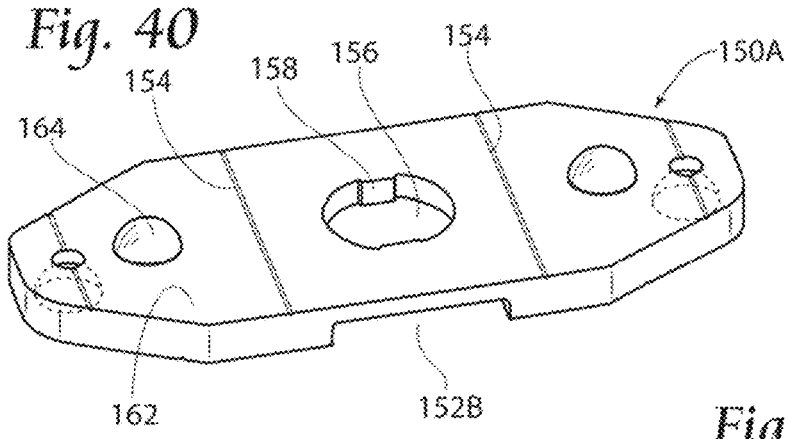
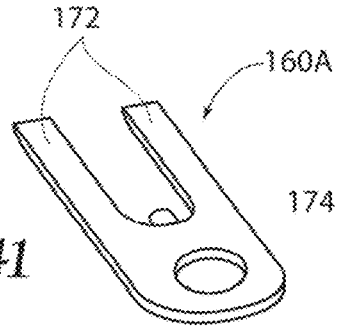
Fig. 41
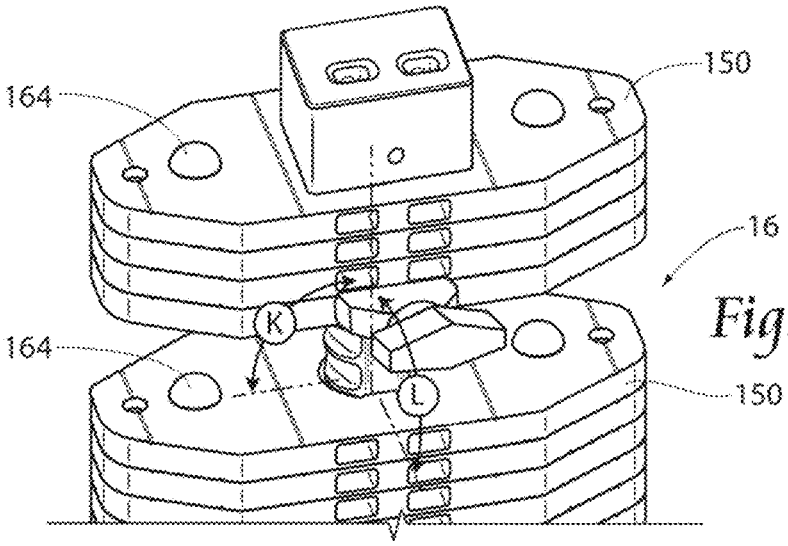
Fig. 42

LINEAR BEARINGS AND ALIGNMENT METHOD FOR WEIGHT LIFTING APPARATUS

RELATED APPLICATIONS

This application is a divisional of application Ser. No. 16/796,411 filed 20 Feb. 2020, which is a divisional of application Ser. No. 16/131,498 filed 14 Sep. 2018, which is a divisional of application Ser. No. 15/477,688 filed 3 Apr. 2017 (now U.S. Pat. No. 10,201,726), which is a divisional of application Ser. No. 14/955,792 filed 1 Dec. 2015 (now U.S. Pat. No. 9,795,824), which is a continuation of U.S. application Ser. No. 14/733,287, filed 8 Jun. 2015 (now U.S. Pat. No. 9,211,435), which is a divisional of U.S. application Ser. No. 13/773,274 filed 21 Feb. 2013, (now U.S. Pat. No. 9,079,068), which claims the benefit of Provisional Application No. 61/601,368 filed 21 Feb. 2012.

BACKGROUND OF THE INVENTION

Exercise equipment, such as weight lifting equipment is popular across all strata of society, including amateurs and professional athletes alike. Users of such equipment include anyone wishing to improve strength physique, or overall muscle conditioning. In practice, weight training uses the weight force of weighted bars, weight stacks or the like to oppose the force generated by muscle. Weight training typically includes the use of specialized equipment to target specialized muscle groups. Such equipment may include free weights, such as dumb bells, bar bells, and kettle bells, or such equipment may include weight machines. There is a fairly large number of weight machines manufactured today. For example, one type of machine includes a barbell that is partially constrained to move only in a vertical manner. Cable-type machines may include two weight stacks with cables running through adjustable pulleys to handles. There are also exercise specific weight machines that are designed to target specific muscle groups or multi-use machines that include multiple exercise-specific capabilities in one apparatus. Another variety includes the use of cam mechanisms (such as those made by Nautilus®) that enable the user to maintain constant or variable muscle force throughout the exercise movement.

Common weight machines may include the use of rectangular weight plates, commonly referred to as a weight stack. In use, the stack may include a hole designed to accept a vertical support bar having a series of holes drilled therein to accept a pin. Each of the plates in the stack may further include a channel or a hole through the middle that aligns with one of the holes in the support bar. When the pin is inserted through the channel or hole, into a selected hole on the bar, all of the plates above the pin rest upon it, and are lifted when the bar rises. The plates below do not rise. Machines of this type provide various levels of resistance over the same range of motion depending on the number of plates resting on the pin to be lifted.

Machines which use a weight snack may vary according to the manner in which the bar is raised. For example, some machines may include a roller and lever combination, while others may include a hinge and lever combination. Still others may include the use of cables, belts or similar devices attached to the bar, with the cable or belts running over a wheel or pulley.

Many manufacturers are known to design and manufacture weight machines. Such manufacturers include Vectra®, FreeMotion™, and MedX®, among others. Manufacturers have each developed systems and machines for aiding the user in developing the desired results. Common weight machines include the use of cables, free weights and levers.

An example of a manufacturer that uses lever-type technology in its equipment is MedX®. As mentioned, the weight stack typically includes a hole designed to accept a vertical support bar having a series of holes drilled therein to accept a pin. As the stack is raised and lowered during use, the stack rides on the vertical support bar, creating friction.

SUMMARY OF THE INVENTION

The present invention relates to weight lifting exercise equipment, particularly improvements to lever style equipment such as that manufactured by MedX®. The improvements contemplated decrease friction on the vertical support bar, increase weight stack stability and further improve on known vertical support bar configurations. Specifically, the present invention provides a device and method for providing exercise equipment employing a linear bearing for decreased friction. The invention further provides a method and apparatus for enhanced alignment, which thereby decreases friction.

BRIEF DESCRIPTION OF THE DRAWINGS

FIG. 38 is a perspective view of a weight selector pin for use with the plate illustrated in FIGS. 36 and 37.

FIG. 39 is a perspective view of an alternative embodiment upper stack plate and showing a pin slot and alignment domes.

FIG. 40 is a perspective view of an alternative embodiment upper stack plate and showing a pin slot and alignment domes.

FIG. 41 is a perspective view of a weight selector pin for use with the plate illustrated in FIGS. 39 and 40.

FIG. 42 is a fragmentary view of an upper weight stack in raised position and showing a torpedo plate on top.

FIG. 43 is a perspective view of a weight frame, similar to that shown in FIG. 44, but showing an upper weight stack and lift rod having single holes.

DESCRIPTION OF THE PREFERRED EMBODIMENT

Although the disclosure hereof is detailed and exact to enable those skilled in the art to practice the invention, the physical embodiments herein disclosed merely exemplify the invention which may be embodied in other specific structures. While the preferred embodiment has been described, the details may be changed without departing from the invention, which is defined by the claims.

Figure 1:
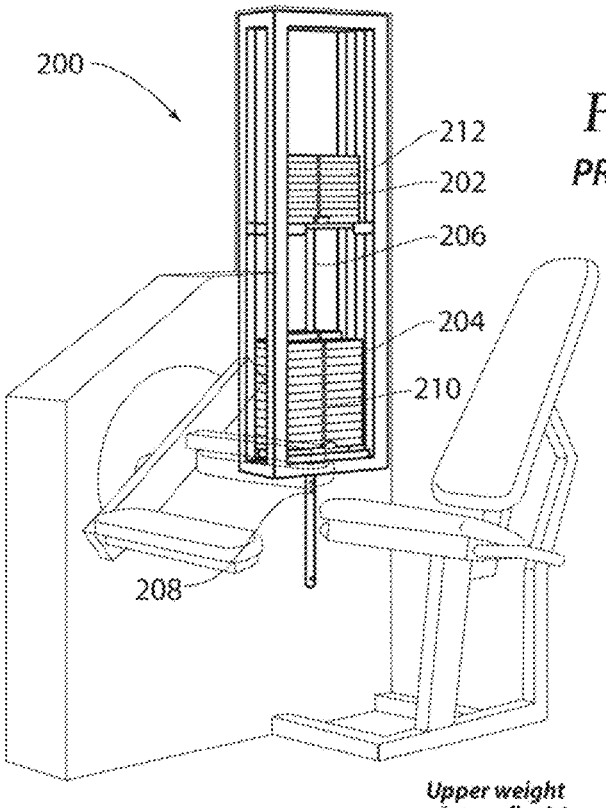
Fig. 1 PRIOR ART
FIG. 1 is a perspective view of a prior art exercise device.
Figure 2:
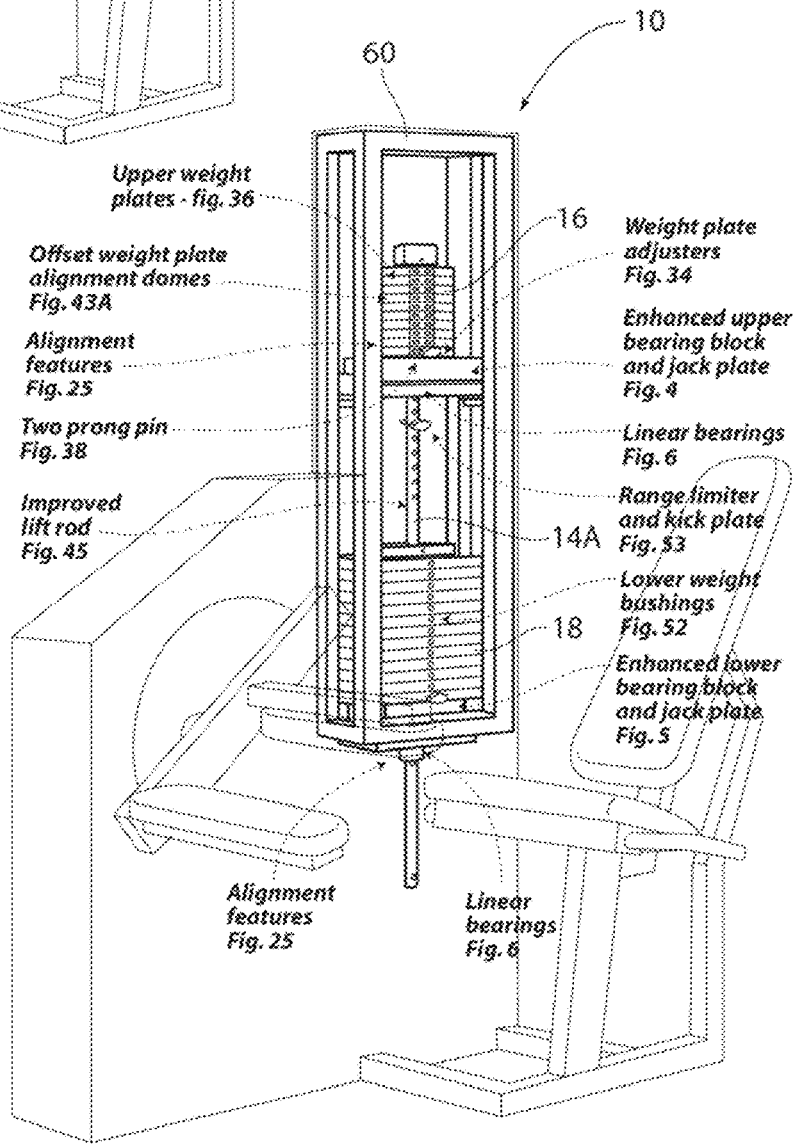
FIG. 2 is a perspective view of exercise equipment with features according to the present invention.

FIG. 1 illustrates a prior art exercise device with prior art weight stack. As shown, the prior art device 200 includes upper and lower weight stacks 202, 204 supported by a vertical lift rod 206. The lift rod 206 includes holes 208 that correspond to holes 210 on weight plates 212. FIG. 2 is a view of an exercise system 10 embodying many of the features according to the present invention, as will be discussed. As seen, the exercise system 10 generally includes a weight stack frame 12 having a vertical lift rod 14, upper weight stack 16 and lower weight stack 18. The system 10 includes the use of linear bearings 20 (shown in FIG. 3), and may include a specialized alignment system and improvements to the upper weight stack 16 and lift rod 14, as will be discussed in detail.

Linear Bearings

The present invention contemplates the use of linear bearings 20 to thereby greatly reduce the undesirable sliding friction on the vertical lift rod 14 that is encountered in typical prior art arrangements. During exercise and use of usual elevator stack systems or lever stack systems, a side load on the lift rod 14 is incurred. Typically, the side load is put on high friction bushings and an unpolished soft rod. Side load creates undesirable frictional drag for the user. Use or linear bearings 20 as described in the present invention provides rolling friction rather than sliding friction, and places the side load onto the rolling elements of the linear bearing 20 rather than the lift rod 14. The present invention contemplates use of linear bearings 20 and novel alignment mechanisms and methods to decrease or eliminate sliding friction and enhance the user's experience while using the system 10.

Figure 3:
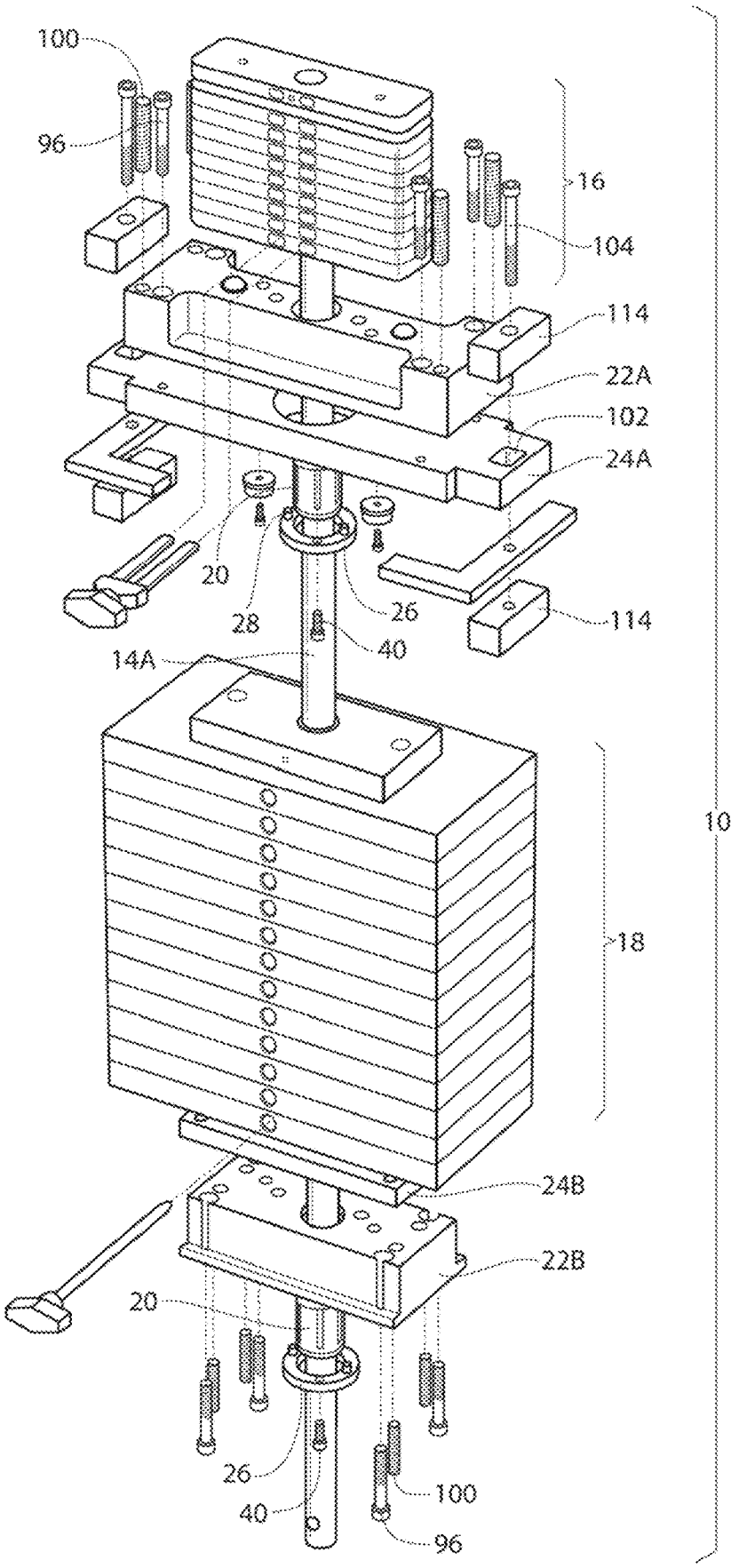
FIG. 3 is an exploded view of a weight stack and lift rod and showing features according to the present invention.
Figure 4:
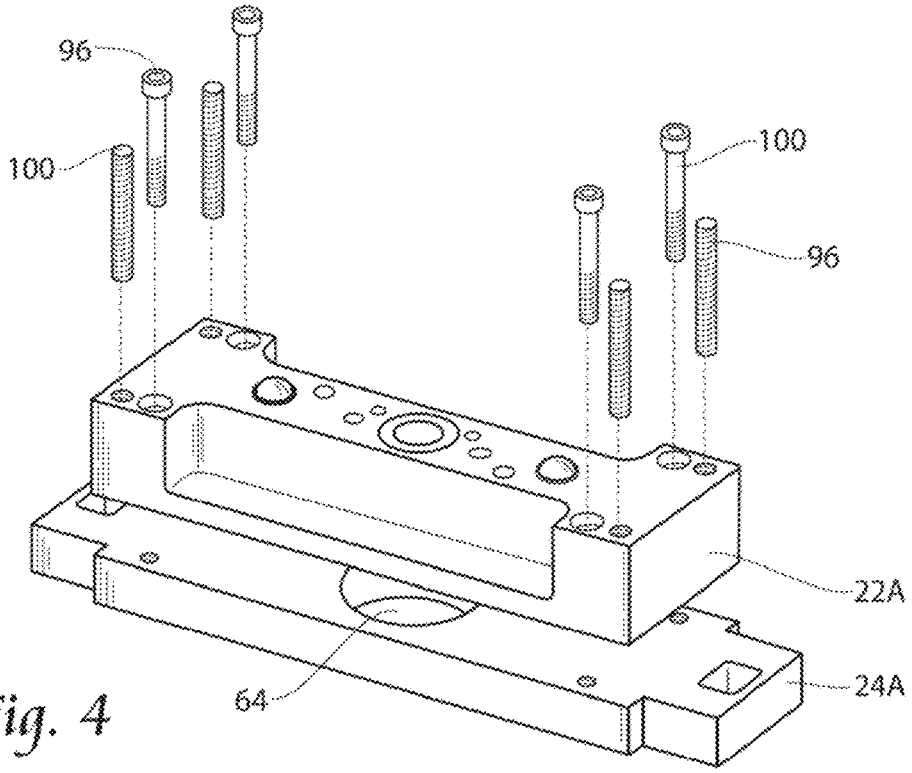
FIG. 4 is an exploded view of the upper bearing block and jack plate illustrated in FIG. 3.
Figure 5:
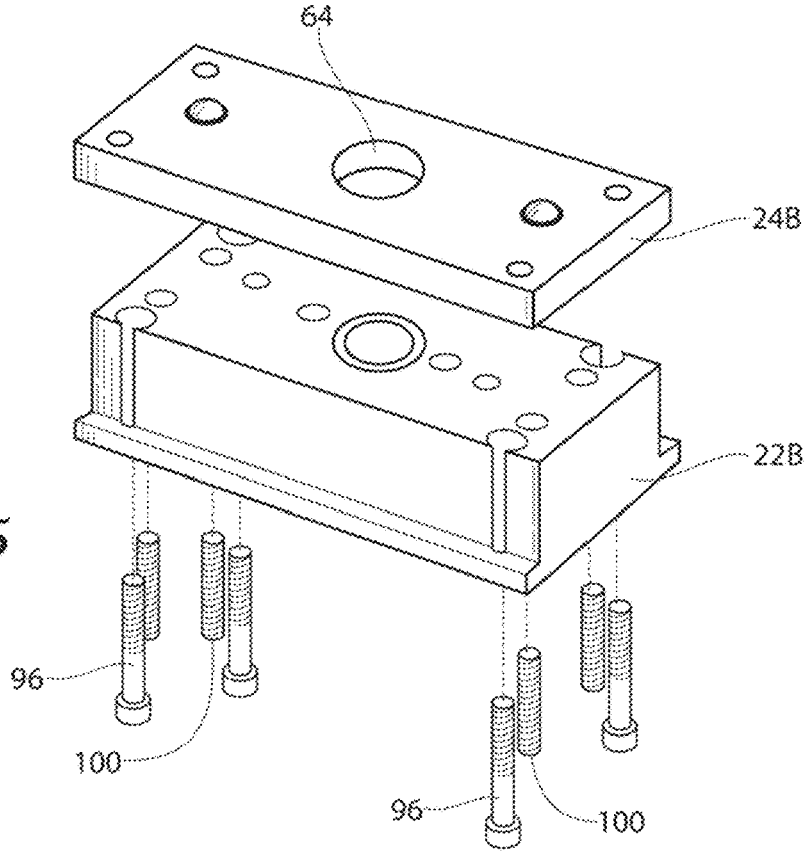
FIG. 5 is an exploded view of the lower bearing block and jack plate illustrated in FIG. 3.

As seen in the exploded view of FIG. 3, the present invention contemplates the use of linear bearings 20 for both the upper weight stack 16 and the lower weight stack 18, although it is to be understood that linear bearings 20 may be used with other lift-type exercise equipment. The views of FIGS. 4 and 5 illustrate an upper bearing block 22A and upper jack plate 24A and lower bearing block 22B and lower jack plate 24B. The upper and lower bearing blocks 22A, 22B are used to house the linear bearings 20. The respective jack plates 24A, 24B are used during alignment, as will be discussed in detail below.

Figure 6:
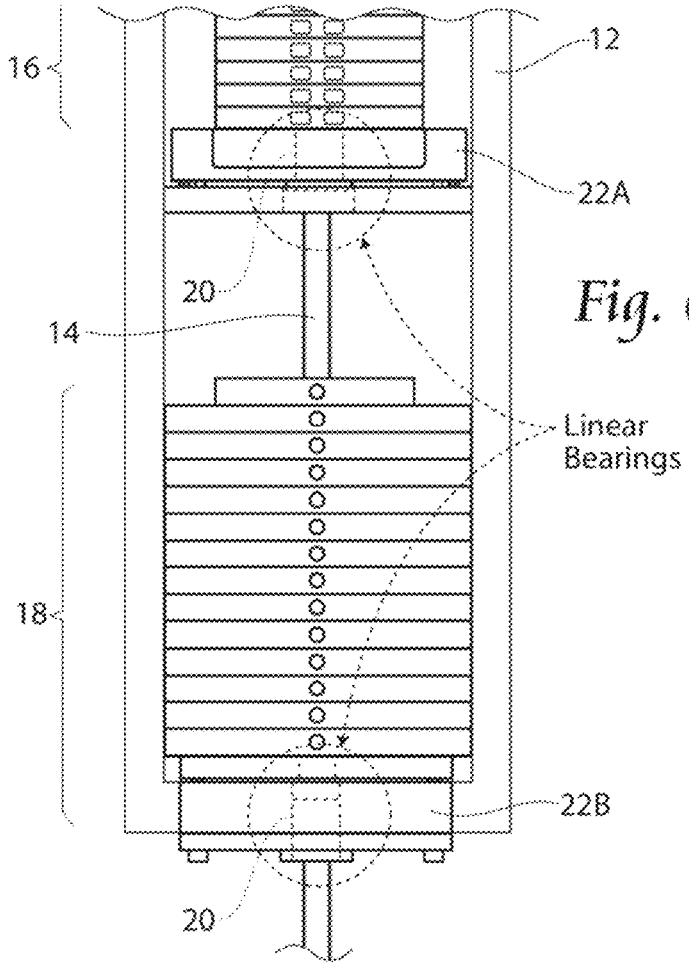
FIG. 6 is a fragmentary view of a weight stack and showing positions of linear bearings.
Figure 7:
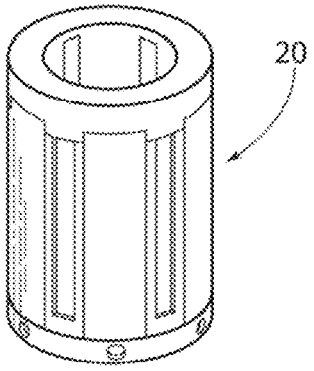
FIG. 7 is a perspective view of a linear bearing for use with the present invention.
Figure 8:
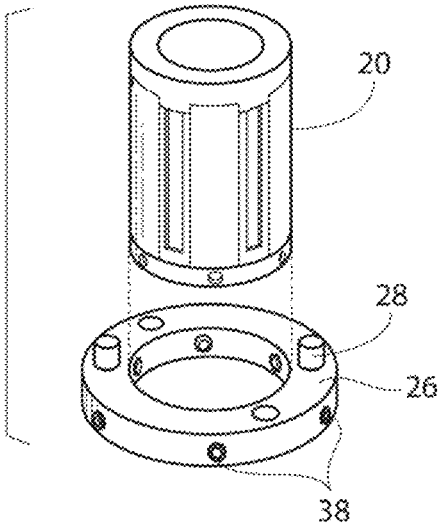
FIG. 8 is an exploded view of a linear bearing and collar.
Figure 9:
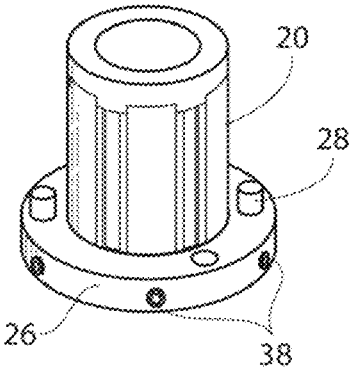
FIG. 9 is a perspective view of the linear bearing and collar illustrated in FIG. 8 in an assembled condition.
Figure 10:
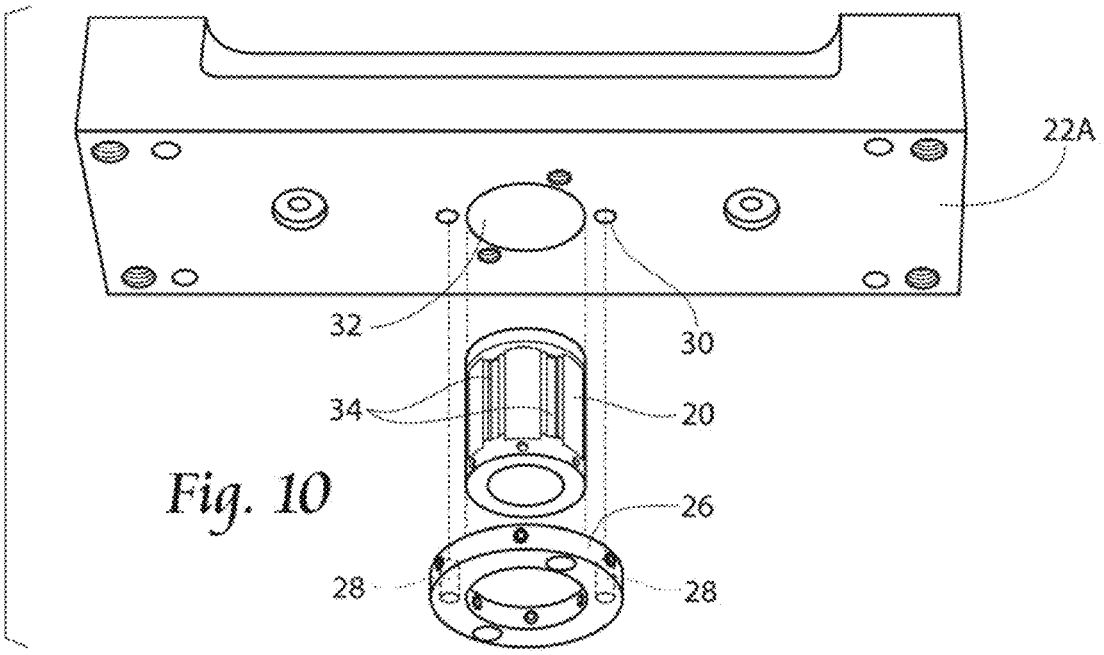
FIG. 10 is an exploded view of an upper bearing block, linear bearing and collar.
Figure 11:
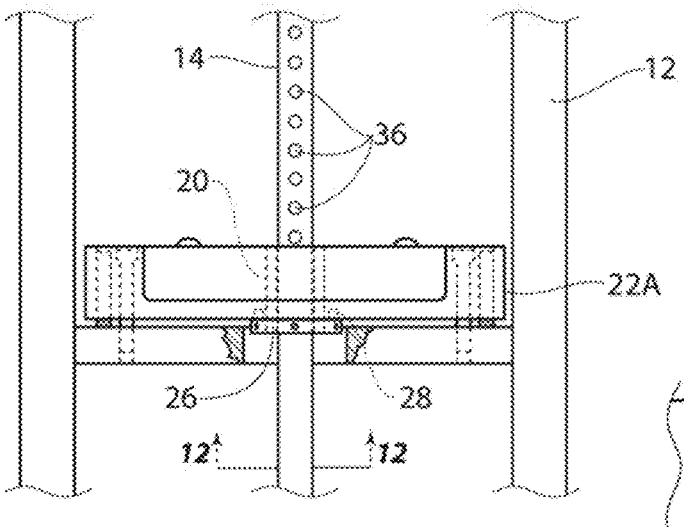
FIG. 11 is a partial section view of a bearing block with linear bearing and attached collar seated onto a jack plate.
Figure 12:
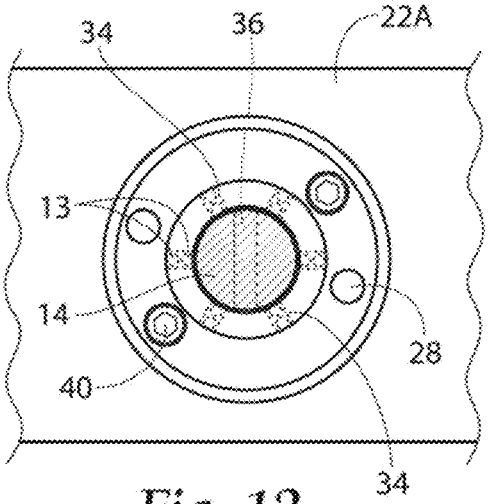
FIG. 12 is a fragmentary bottom view of an installed bearing showing positioning of bearing raceways, positioning pins and lift rod holes.

Linear bearings 20 for use with the present system 10 may be seen in the views of FIGS. 6-19. As shown, particularly in the view of FIG. 6, linear bearings 20 may be positioned under both the upper weight stack 16 and the lower weight stack 18. While the Figures illustrate a system 10 having an upper weight stack 16 and a lower weight stack 18, it is to be understood that the linear bearing 20 configurations contemplated may be employed in other weight lift systems which employ a lift rod 14. The view of FIG. 7 depicts an illustrative linear bearing 20 for use with the present system 10. As shown in FIG. 8, the bearing 20 may further include a collar 26 having upstanding pins 28. The upstanding pins 28 on the collar 26 are arranged for alignment fit with corresponding apertures 30 in the bearing block 22A or 22B (see FIG. 10). The linear bearing 20 with attached collar 26 is fit into a bearing aperture 32 in bearing block 22A or 22B with the upstanding pins 28 assuring that the linear bearing 20 is properly positioned in the bearing aperture 32. Proper positioning of the linear bearing 20 in the bearing block aperture 32 is critical. As shown in FIG. 12, the linear bearing 20 must be aligned such that the bearings 33 in their respective raceways 34 are oriented to avoid the lift rod holes 36 in the lift rod 14 when the machine is in use. As seen in FIG. 11, when the linear bearing 20 is installed properly in the bearing block 22A, 22B the bearings 20 contact the lift rod 14 yet avoid the lift rod holes 36. The linear bearing 20 fits into the collar 26 and is held in place by way of radially extending screws 38 or other known means (see FIG. 8). As illustrated in FIGS. 3 and 10, the linear bearing 20 and its attached collar 26 is held in the bearing block 22A, 22B by way of the threaded screw 40 arrangement shown, by way of non-limiting example.

Figure 13:
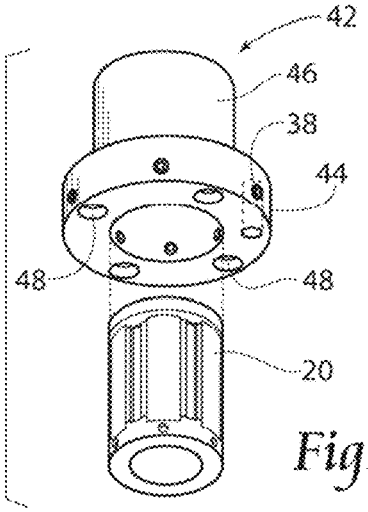
FIG. 13 is a partially exploded view of a linear bearing for use with the present invention.

An alternative linear bearing 20 arrangement may be seen in the view of FIG. 13. In this view, the linear bearing 20 is housed in a cartridge 42. As shown, the cartridge 42 includes a collar portion 44 and upstanding housing portion 46. Similar to the previous bearing 20 arrangement, the bearing 20 illustrated in FIG. 13 may be held in the cartridge 42 by way of set screws 38 that are positioned through radially extending apertures in the collar portion 44. Set screws 38 may be tapered to ensure solid contact with the linear bearing 20. As seen, the collar portion 44 further includes axially extending apertures 48 for receipt of screws (not shown in this view) used to attach the bearing 20 with its cartridge 42 to a bearing block 22A, 22B.

Figure 14:
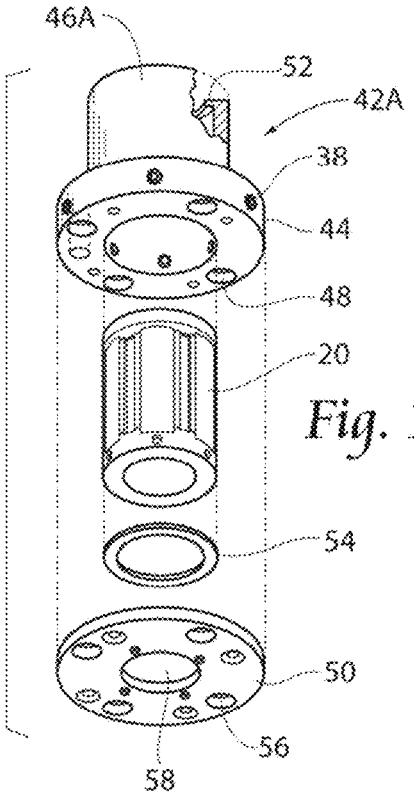
FIG. 14 is an exploded partially cut away view of an alternative linear bearing for use with the present invention.
Figure 15:
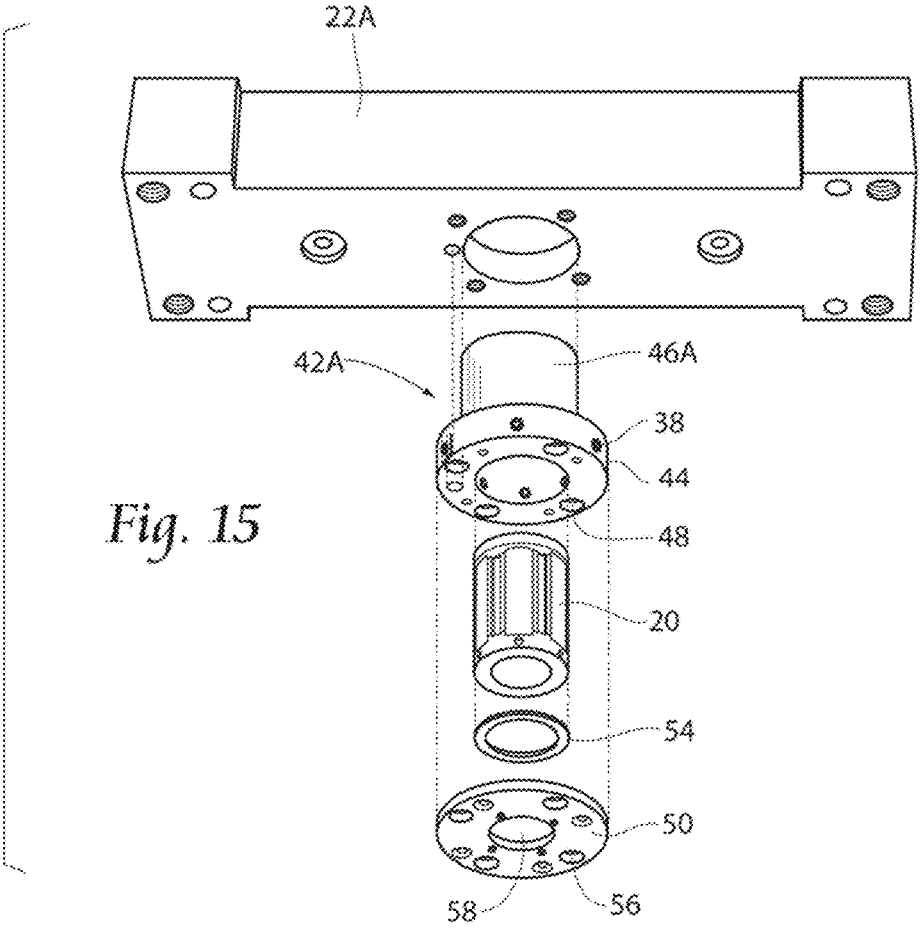
FIG. 15 is an exploded view of a linear bearing cartridge and upper bearing block.

Another linear bearing 20 arrangement may be seen in the view of FIGS. 14 and 15. In these views, the linear bearing 20 is housed in a modified cartridge 42A and includes a bottom plate 50. As shown, similar to the embodiment described in FIG. 13, the cartridge 42A includes a collar portion 44 and upstanding housing portion 46A. The housing portion 46A may further include a flange 52 to aid in retention of the linear bearing 20. Similar to the previous bearing 20 arrangements, the bearing 20 illustrated in FIGS. 14 and 15 may be held in the cartridge 42A by way of set screws 38 that are positioned through radially extending apertures in the collar portion 44. The bearing 20 may be further supported in the cartridge 42A by a bottom plate 50 and washer 54. As may be seen, the bottom plate 50 includes a plurality of bottom plate apertures 56 arranged to align with corresponding apertures 48 in the collar portion 44. A bottom plate central aperture 58 is sized to allow the bearing 20 to sit securely on the bottom plate 50. Furthermore, the apertures 48 in the collar portion 44 allow for receipt of screws (not shown in this view) used to attach the bearing 20 with the bottom plate 50 to a bearing block 22A or 22B.

Figure 16:
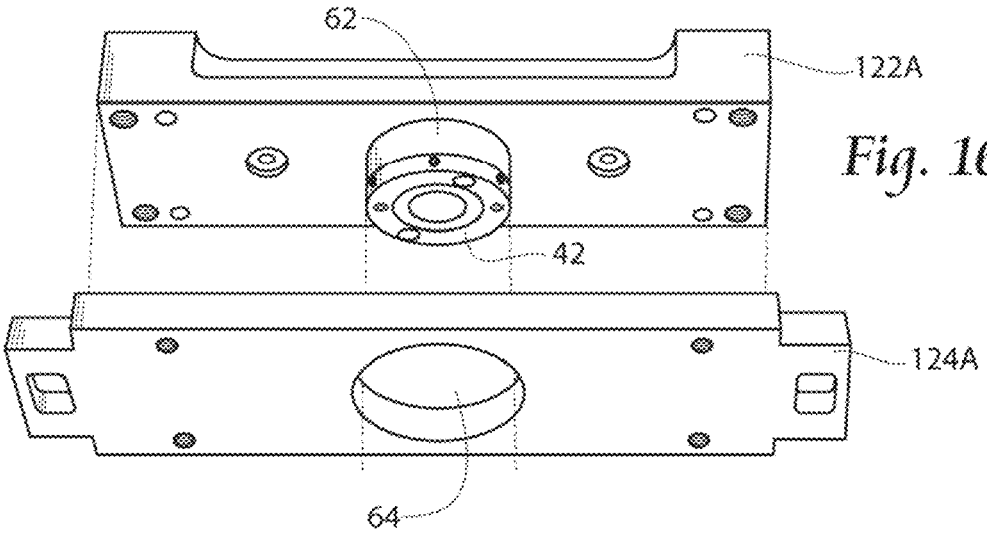
FIG. 16 is an exploded view of an upper bearing block with lower protrusion and jack plate having an alternative diameter hole.
Figure 17:
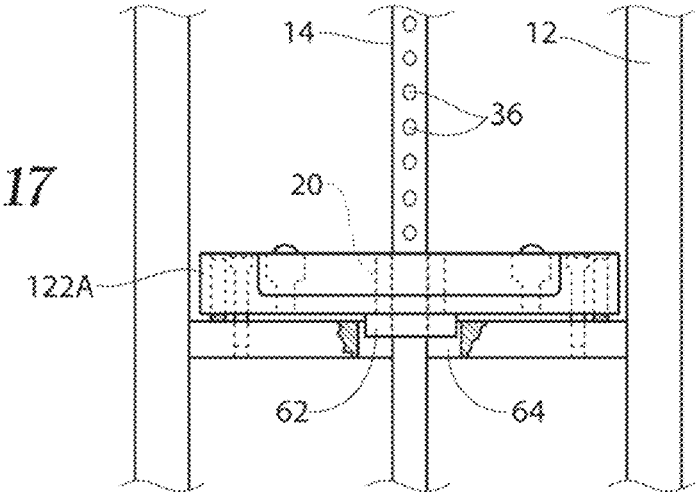
FIG. 17 is a partial section front view of an upper bearing block seated in the jack plate illustrated in FIG. 16.
Figure 18:
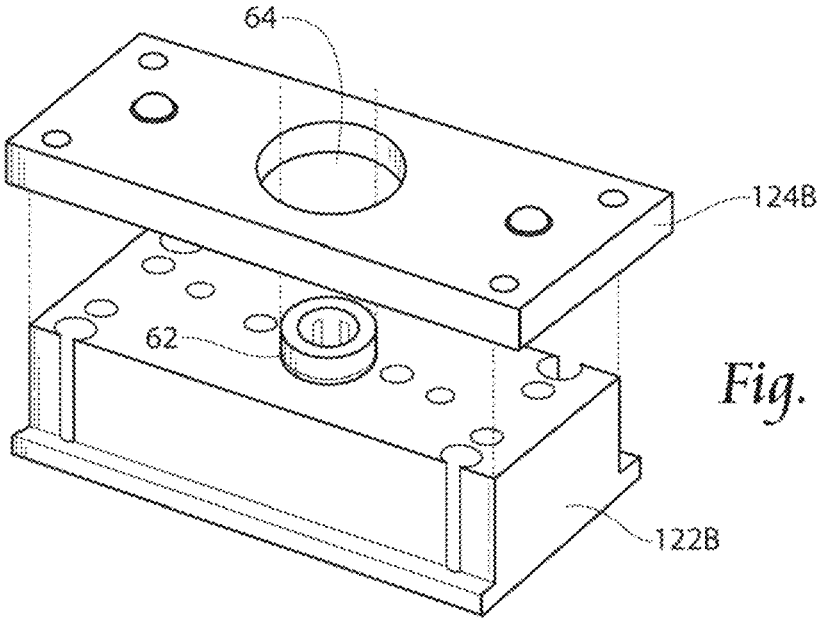
FIG. 18 is an exploded view of a lower bearing block with protruding linear bearing and jack plate with larger diameter hole.
Figure 19:
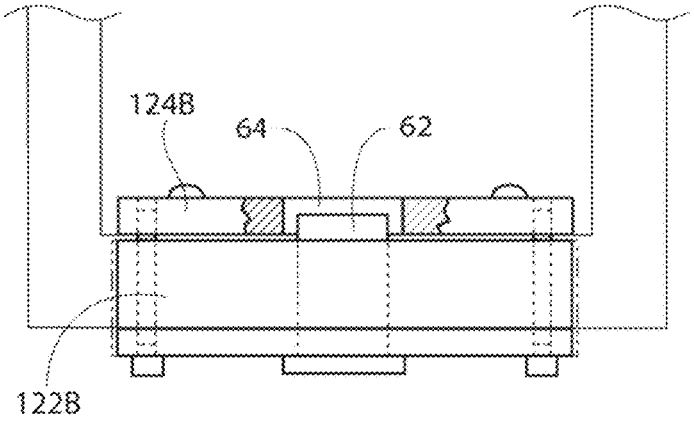
FIG. 19 is a partial section front view of a lower bearing block seated into the jack plate illustrated in FIG. 16.

Another linear bearing 20 arrangement may be seen in the views of FIGS. 16-19. In these views, the bearing blocks 121A, 122B have a reduced thickness as compared to the previously described bearing blocks 22A, 22B. A reduced thickness bearing block 122A, 122B permits more clearance at the top of each weight stack 16, while permitting more clearance at the bottom of weight stack 18. Extra clearance at the top of weight stack 16 reduces the incidence of finger pinch or other unwanted effects caused by the weight stack 16 reaching an upper range limit at the top 60 of the frame 12. The reduced thickness bearing block 122B gives additional clearance below the weight stack 18 for the mechanics (not shown) that drive the weight stack 18. To accommodate a linear bearing 20 in a bearing block 122A, 122B having reduced thickness, certain bearing block 122A, 122B modifications are contemplated. The bearing blocks 122A, 122B illustrated in these views preferably include a laterally extending cylindrical protrusion 62. As shown, the bearing 20 with cartridge 42 or modified cartridge 42A may be retained in the cylindrical protrusion 62 in a manner similar to that mentioned previously with respect to the attachment in other bearing blocks 22A, 22B. The jack plates 124A, 124B include a central aperture 64 sized to receive the protrusion 62. The views of FIGS. 16 and 17 illustrate the various components 20, 42, 62 seated in a jack plate 124A.

Alignment System

As mentioned previously, accurate alignment of the various weight system 10 components, particularly alignment of the linear bearing 20 relative the lift rod 14, is of utmost importance to thereby minimize friction on the vertical lift rod 14 and to reduce instability of the weight stacks 16, 18 while the system 10 is in use. To assist in proper alignment, the present invention contemplates a novel alignment system for use in weight system 10 set up prior to use. For ease of understanding, a short alignment rod 66 is used to align the lower bearing block 22B and lower jack plate 24B first, and a longer alignment rod 80 is used to align the upper bearing block 22A and upper jack plate 24A second.

Figure 20:
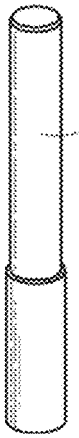
FIG. 20 is a perspective view of a mechanical alignment rod for use with a lower weight stack.
Figure 21:
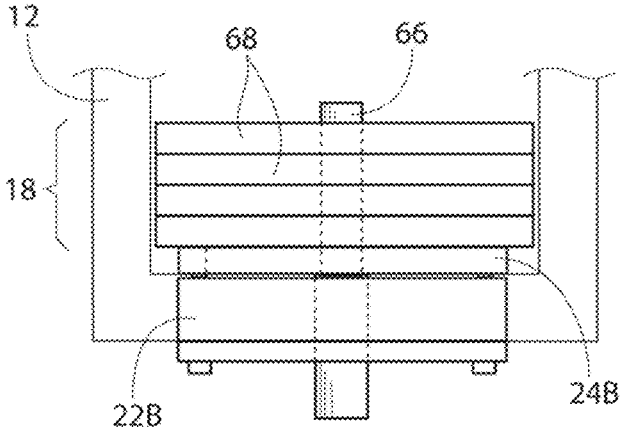
FIG. 21 is a front view of the mechanical alignment rod illustrated in FIG. 20 and showing it in place on a lower bearing block and weight stack.
Figure 22:
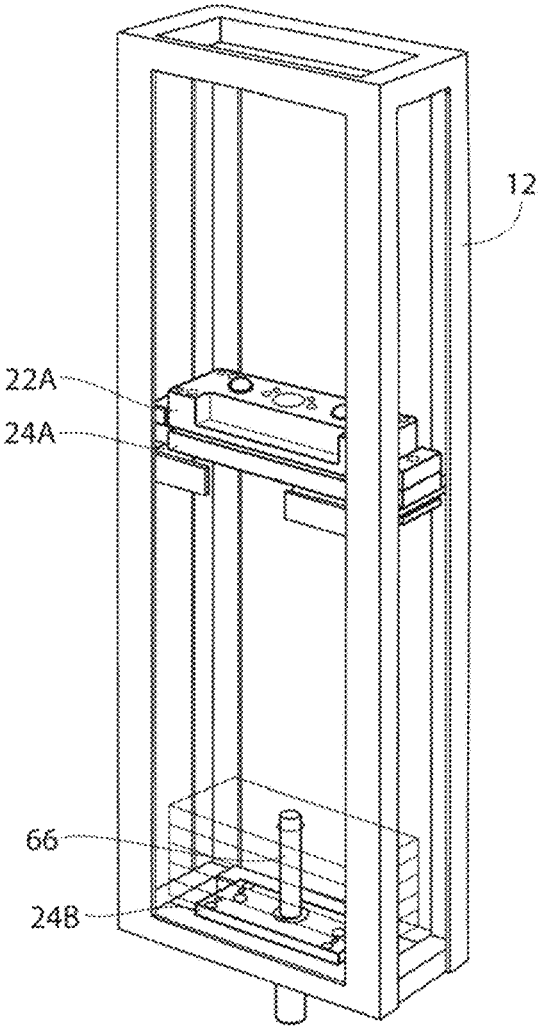
FIG. 22 is a perspective view showing a lower mechanical alignment rod in a weight stack frame.

The views of FIGS. 20 and 21 illustrate the mechanical alignment rod 66 for use in preliminary alignment of the lower bearing block 22B and lower jack plate 24B. As shown, the alignment rod 66 is positioned through the lower bearing block 22B linear bearing 20, through the jack plate 24B aperture 64 (see FIG. 5), and through apertures in lower weight stack 18 plates 68, if the plates 68 are present. One can use the alignment rod 66 without the plates 68 installed and still get the lower bearing block 22B in preliminary alignment. With reference to FIG. 21, the mechanical alignment rod 66 is shown with the lower bearing block 22B and lower jack plate 24B in basic alignment and ready for the next step in refined alignment.

FIGS. 23-30 illustrate the components and method used to align the various components of the weight system 10, after initial alignment, so that as the linear bearings 20 travel on the lift rod 14 during use, minimal friction is created on the lift rod 14. To achieve this, bearing blocks 22A, 22B and jack plates 24A, 24B must be properly aligned since, as described above, the linear bearings 20 reside in the bearing blocks 22A, 22B.

Figure 23:
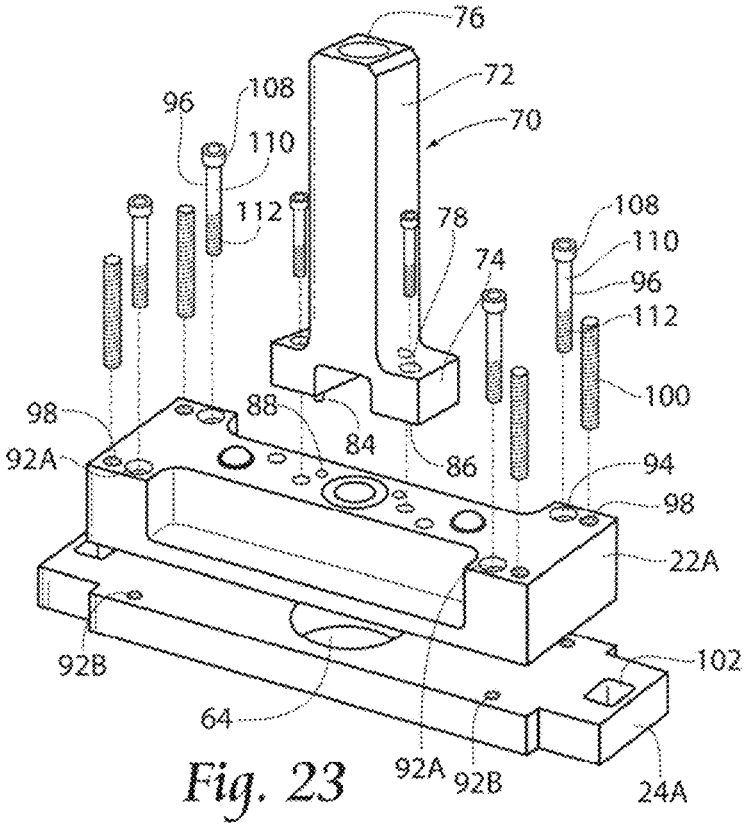
FIG. 23 is an exploded view of an upper alignment tool and bearing block.
Figure 25:
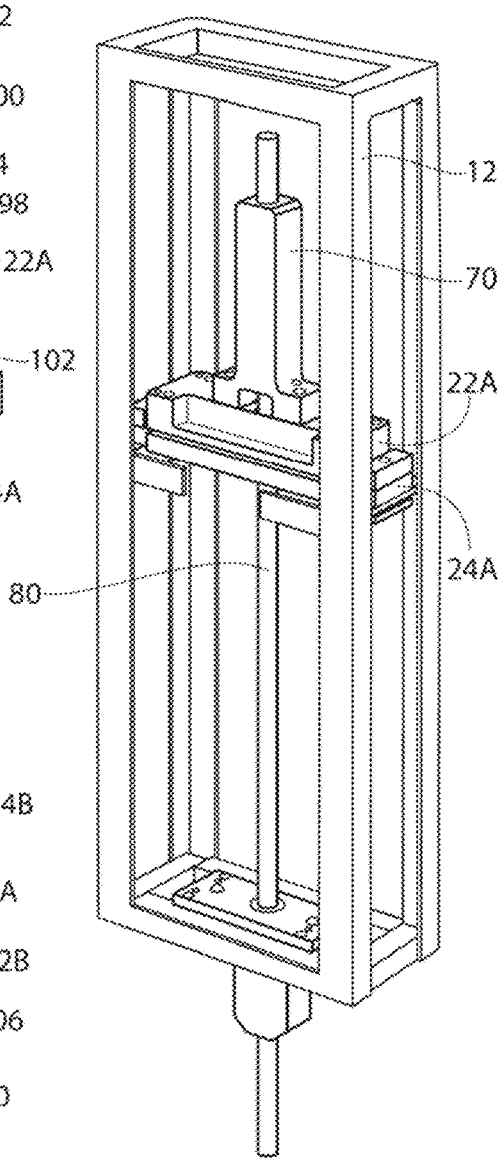
FIG. 25 is a perspective view showing mechanical upper and lower alignment tools in place with solid alignment rod in a weight stack frame.

FIG. 23 is an exploded view showing an upper alignment tool 70 and its relationship to the upper bearing block 22A and upper jack plate 24A during use in alignment adjustment. As seen, the upper alignment tool 70 includes an upstanding portion 72 and a transverse portion 74 with the upstanding portion 72 including a throughbore 76 sized to receive the vertical alignment rod 80 (see FIG. 25). During alignment, the upper alignment tool 70 is positioned with the alignment rod 80 extending through the throughbore 76. The transverse portion 74 includes means for attachment to the upper bearing block 22A, such as the mating apertures 78 and screws 82 shown. As will be seen, during alignment, the upper alignment tool 70 may be manipulated in several planes to thereby urge the upper bearing block 22A and upper jack plate 24A into proper aligned configuration with the alignment rod 80.

With further attention to FIG. 23, locator dowels 84 may be seen located on the underside 86 of the transverse portion 74. Locator dowels 84 are seated in corresponding dowel apertures 88 in the top surface 90 of the upper bearing plate 22A. When the locator dowels 84 are properly seated, the upper alignment tool 70 is in proper position to begin the alignment process. As shown, the upper bearing block 22A is also provided fastener apertures 92A which align with fastener apertures 92B in the upper jack plate 24A. It is to be noted that the fastener apertures 92B in the upper jack plate 24A are threaded and of a slightly smaller diameter than the fastener apertures 92A in the upper bearing block 22A, with the upper bearing block apertures 92A further including a countersunk portion 94. The significance of the variance in relative diameters of the fastener apertures 92A, 92B will be discussed with reference to the alignment process. The fastener apertures 92A, 92B are adapted to receive fasteners, such as the attachment screws 96 shown, to attach the upper bearing block 22A to the upper jack plate 24A. The upper bearing block 22A is further provided with adjustment screws apertures 98 which receive adjustment screws 100. During the alignment process, which will be discussed below, the adjustment screws 100 act to influence the position of the upper bearing block 22A relative to the alignment rod 80 and the upper jack plate 24A. As may be seen, the upper jack plate 24A includes elongate apertures 102 for attachment to the frame 12 via screws 104 or other means. The elongate apertures 102 also permit manipulation and alignment of the upper jack plate 24A during alignment.

Figure 24:
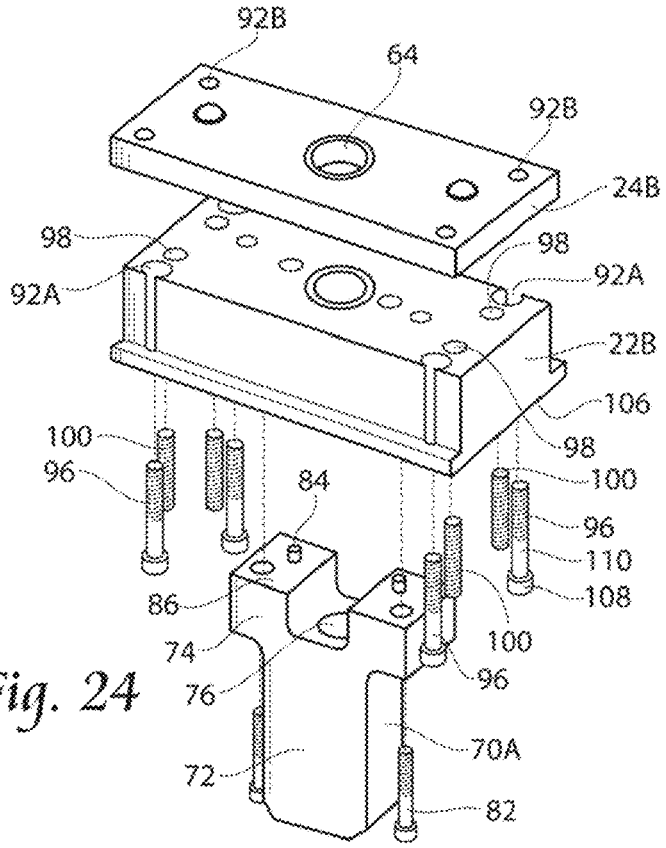
FIG. 24 is an exploded view of a lower alignment tool and bearing block.

With attention now to the exploded view of FIG. 24, the lower bearing block 22B, lower jack plate 24B, and lower alignment tool 70A may be seen. Similar to the description of FIG. 23, the lower alignment tool 70A includes an upstanding portion 72 and a transverse portion 74 with the upstanding portion 72 including a throughbore 76 sized to receive the vertical alignment rod 80. During alignment, the lower alignment tool 70A is positioned with the alignment rod 80 extending through the throughbore 76. The transverse portion 74 includes means for attachment to the lower bearing block 22B, such as the screws 82 shown. As will be seen, in use, the lower alignment tool 70A may be manipulated in several planes to thereby urge the lower bearing block 22B and lower jack plate 24B into proper aligned configuration with the alignment rod 80.

Similar to the upper alignment tool 70, locator dowels 84 may be situated on the underside 86 of the transverse portion 74 of the lower alignment tool 70A. Locator dowels 84 are seated in corresponding dowel apertures (not seen in this view) in the bottom surface 106 of the lower bearing block 22B. When the locator dowels 84 are properly seated, the lower alignment tool 70A is in proper position to begin the alignment process.

As shown, the lower bearing block 22B is also provided with fastener apertures 92A which align with fastener apertures 92B in the lower jack plate 24B. As in the upper bearing block 22A, the fastener apertures 92B in the lower jack plate 24B are threaded and of a slightly smaller diameter than the fastener apertures 92A in the lower bearing block 22B, with the lower bearing block apertures 92A further including a countersunk portion 94 (not shown in this view). The fastener apertures 92A, 92B are adapted to receive fasteners, such as the attachment screws 96 shown, to attach the lower bearing block 22B to the lower jack plate 24B. Similar to the upper bearing block 22A, the lower bearing block 22B is also provided with adjustment screws apertures 98 which receive adjustment screws 100. During the alignment process, the adjustment screws 100 act to influence the position of the lower bearing block 22B relative to the alignment rod 80.

FIGS. 26A-29B depict the various alignment manipulations achieved through use of the described alignment components, with FIGS. 26A-27B illustrating use of the upper alignment tool 70 and FIGS. 28A-29B illustrating use of the lower alignment tool 70A.

Figure 26A:
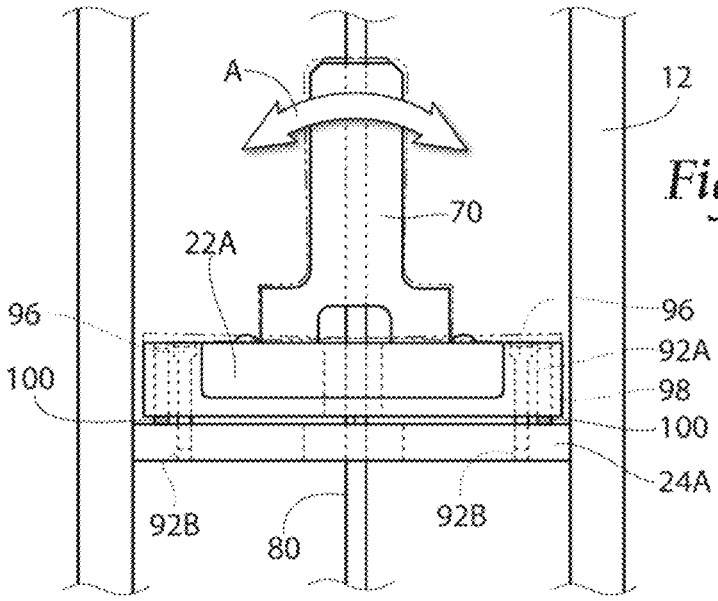
FIG. 26A is a front view of an upper bearing block with alignment tool and showing angled adjustment movements.
Figure 26B:
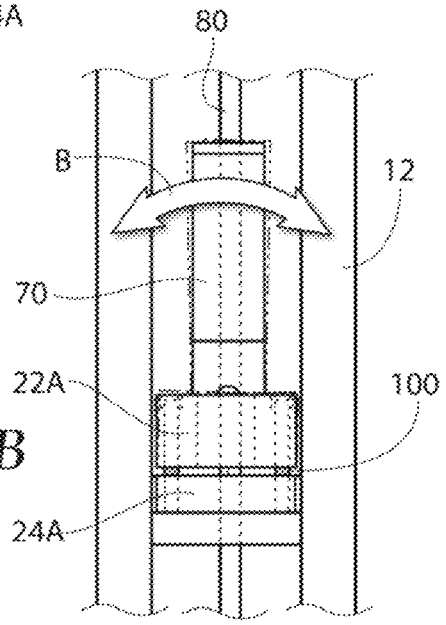
FIG. 26B is a side view of an upper bearing block with alignment tool and showing angled adjustment movements.

With specific reference to FIG. 26A, the upper alignment tool 70 is seen in adjusting the upper bearing block 22A in the direction of arrow A. During aligning adjustment, the attachment screws 98 are preferably set to a position such that the screw head 108 (see FIG. 23) is above the countersunk portion 94 of the fastener aperture 92A. Since the fastener apertures 92B in the upper jack plate 24A are threaded and of a slightly smaller diameter than the fastener apertures 92A in the upper bearing block 22A, when the attachment screw 96 is in the adjustment position, the upper bearing block 22A has some freedom to move about the non-threaded portion 110 (see FIG. 23) of the attachment screw 96 in the upper bearing block fastener aperture 92A. The threaded portion 112 of the attachment screw 96 remains seated in the threaded upper jack plate fastener aperture 92B. Position of the upper alignment tool 70 and attached upper bearing block 22A is manipulated and maintained by the adjustment screws 100. With reference to the view of FIG. 26B, the upper alignment tool 70 is seen adjusting the upper bearing block 22A in the direction of arrow B. When proper alignment is achieved, the attachment screw 96 is positioned with the head portion 108 seated in the countersunk portion 94 of the bearing block fastener aperture 92A, to thereby lock the upper bearing block 22A in aligned position.

Figure 27A:
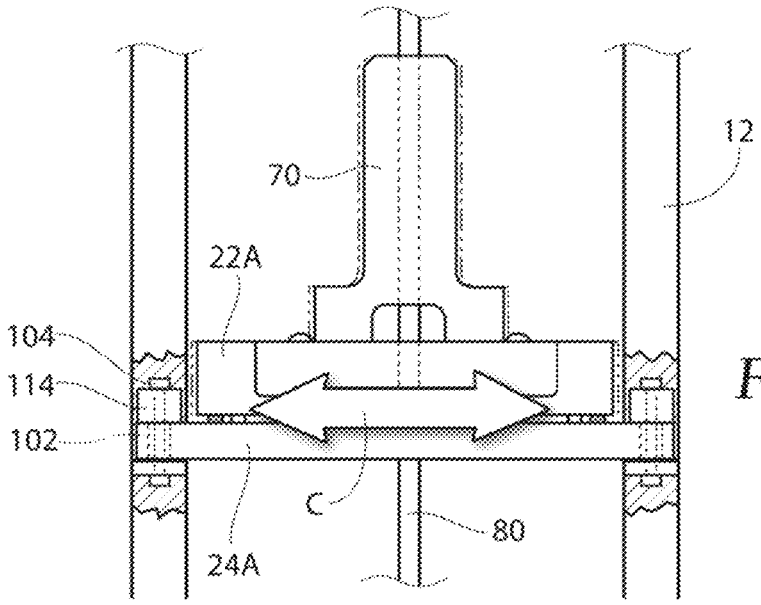
FIG. 27A is a front view of an upper bearing block with alignment tool and showing lateral adjustment movements.
Figure 27B:
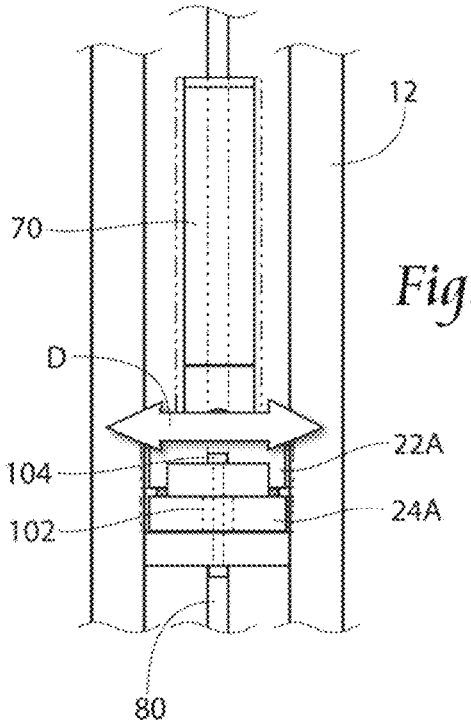
FIG. 27B is a side view of an upper bearing block with alignment tool and showing lateral adjustment movements.
Figure 28A:
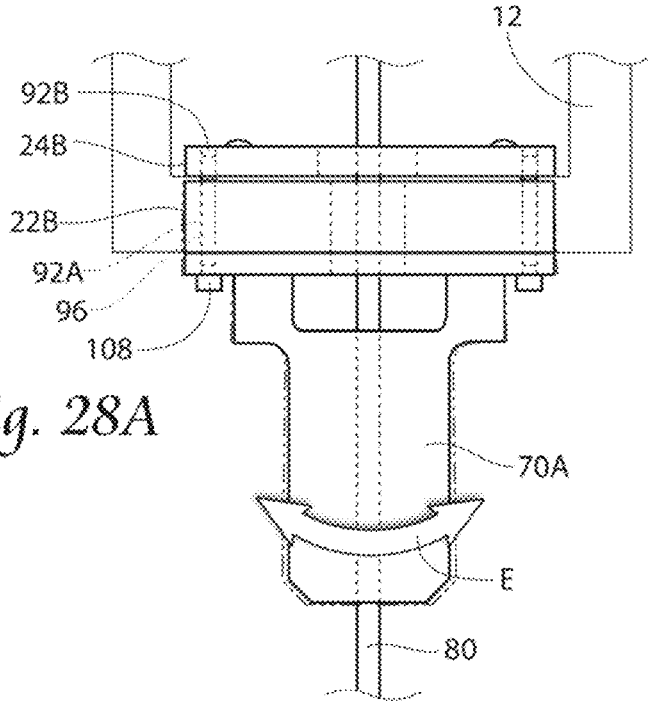
FIG. 28A is a front view of a lower bearing block with alignment tool and showing angled adjustment movements.
Figure 28B:
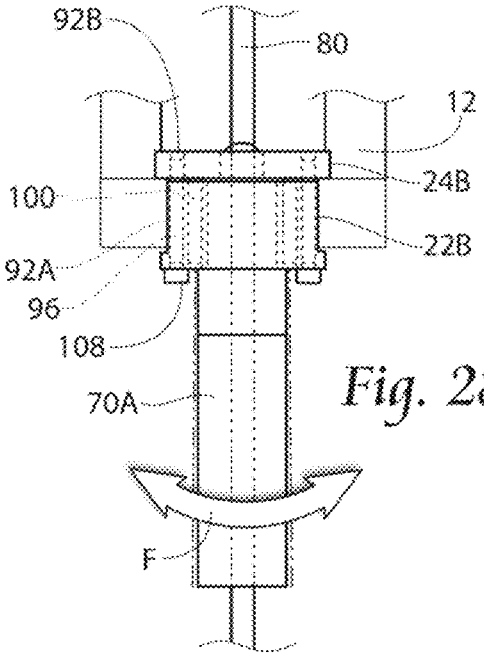
FIG. 28B is a side view of a lower bearing block with alignment tool and showing angled adjustment movements.

FIG. 27A illustrates the upper alignment tool 70 adjusting the upper jack plate 24A in the direction of arrow C. During adjustment of the upper jack plate 24A, the attachment screws 104 (see FIG. 3) for elongate apertures 102 (see FIG. 23) are loosened to allow manipulation and alignment of the upper jack plate 24A about the elongate apertures 102. With reference to the view of FIG. 27B, the upper alignment tool 70 is seen adjusting the upper jack plate 24A in the direction of arrow D. When proper alignment is achieved, the attachment screw 104 is positioned to secure the upper jack plate 24A between blocks 114 (See FIG. 3) and to the frame 12, to thereby lock the upper jack plate 24A in aligned position.

Now with reference to the views of FIGS. 28A-29B, alignment of the lower bearing block 22B and lower jack plate 24B may be viewed. In a manner similar to that of the upper bearing block 22A, the lower bearing block 22B may also be manipulated by lower alignment tool 70A to achieve alignment. The lower alignment tool 70A may be seen particularly in FIG. 28A, during adjustment of the lower bearing block 22B in the direction of arrow E. As with the alignment of the upper bearing block 22A, during aligning adjustment, the attachment screws 96 are preferably set to a position such that the screw head 108 is above the countersunk portion 94 (not seen in this view) of the fastener aperture 92A. Again, the fastener apertures 92B in the lower jack plate 24B are threaded and of a slightly smaller diameter than the fastener apertures 92A in the lower bearing block 24B, to permit the lower bearing block 22B freedom to move about the non-threaded portion 110 (see FIG. 24) of the attachment screw 96 in the lower bearing block fastener aperture 92A during alignment. The lower alignment tool 70A and attached lower bearing block 22B is then manipulated and maintained by the adjustment screws 100. With reference to the view of FIG. 28B, the lower alignment tool 70A is seen adjusting the lower bearing block 22B in the direction of arrow F. When proper alignment is achieved, the attachment screw 96 is positioned with the head portion 108 seated in the countersunk portion 94 of the lower bearing block fastener aperture 92B, to thereby lock the lower bearing block 22B in aligned position.

Figure 29A:
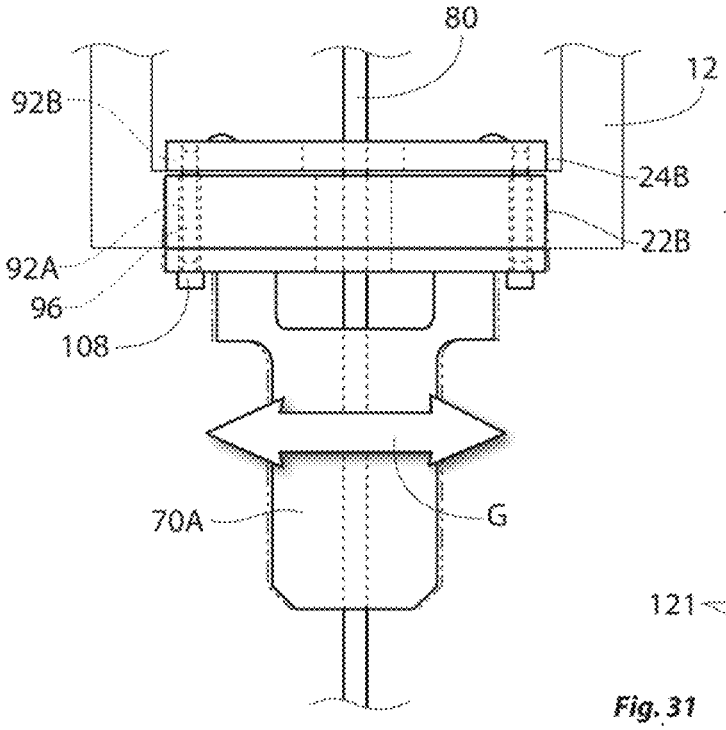
FIG. 29A is a front view of a lower bearing block with alignment tool and showing lateral adjustment movements.
Figure 29B:
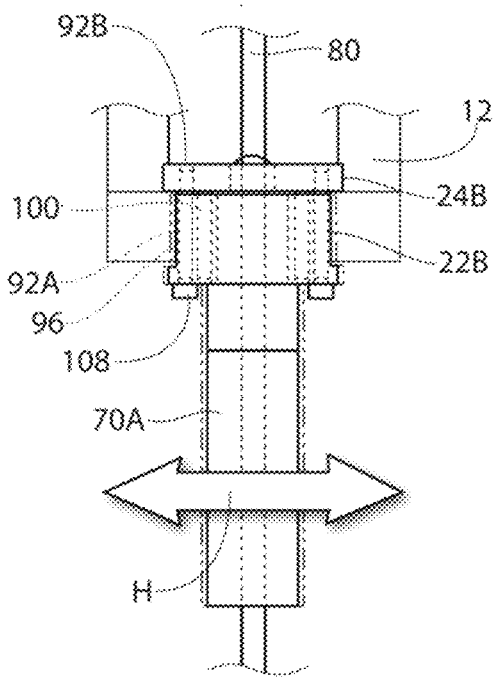
FIG. 29B is a side view of a lower bearing block with alignment tool and showing lateral adjustment movements.
Figure 30:
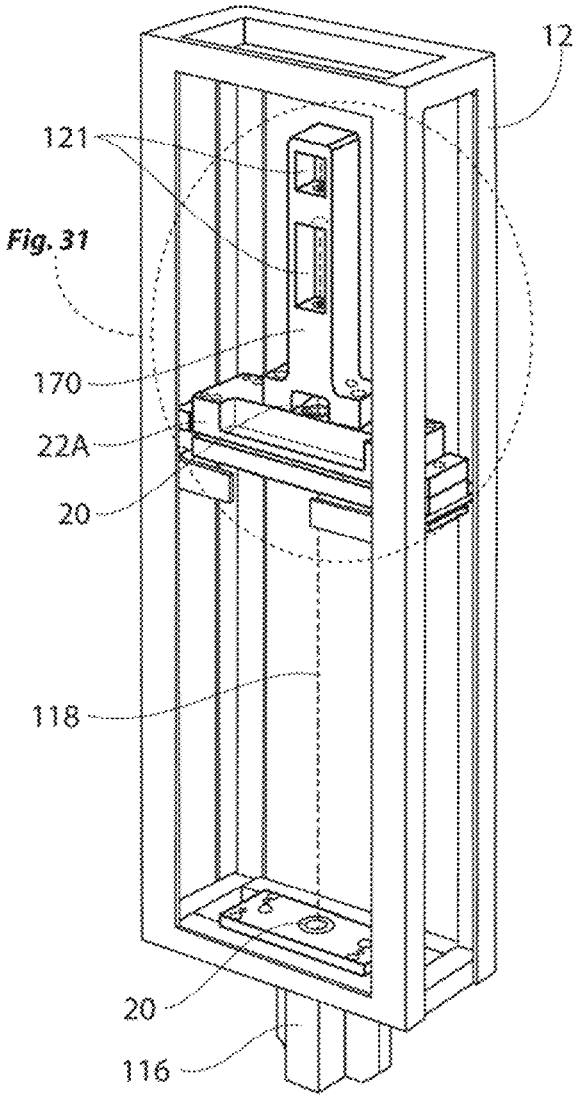
FIG. 30 is a perspective view of a weight stack frame and showing an alignment tool on an upper bearing block and laser attached to a lower block.

FIGS. 29A and 29B illustrate the lower alignment tool 70A adjusting the lower bearing block 22B in the direction of arrows G and H, respectively. With reference to the view of FIG. 29B, the lower alignment tool 70A is seen adjusting the lower bearing block 22B in the direction of arrow H. When proper alignment is achieved, the attachment screw 96 is positioned to secure the lower jack plate 24B to the lower bearing block 22B and to the frame 12, to thereby lock the lower bearing block 24A in aligned position.

Laser Guided Alignment

Figure 31:
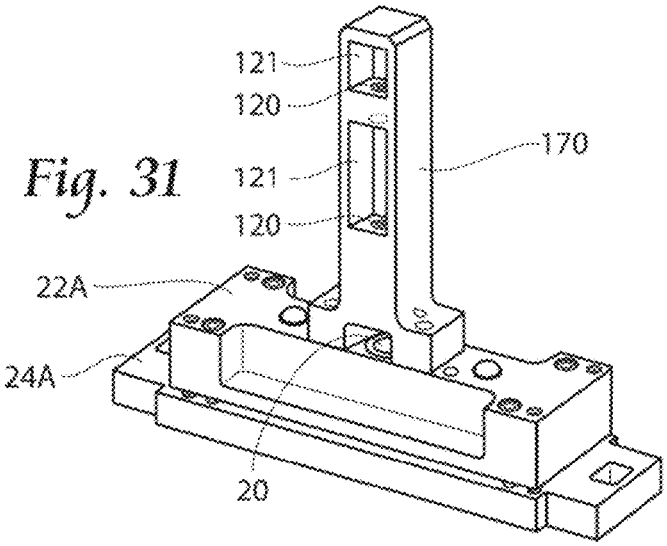
FIG. 31 is an enlarged view of the laser alignment tool referenced generally as FIG. 31 in FIG. 30.

An alternative alignment method may be seen in the views of FIGS. 30-33. Here a laser 116 is used to assist in alignment, therefore the alignment rod 80, seen in previous views, is not required. As seen, a laser 116 is mounted beneath the lower bearing block 22B. A beam 118 is directed though the lower linear bearing 20, lower and upper jack plate apertures 64 and through the upper linear bearing 20. As illustrated in FIG. 31, the laser upper alignment tool 170 is modified from that seen previously to include multiple laser apertures 120 with open windows 121 for visual verification of alignment. The bearing blocks 22A, 22B are manipulated in the manner described with respect to FIGS. 23-29B, with the laser beam 118 being used to guide the alignment process.

Figure 32:
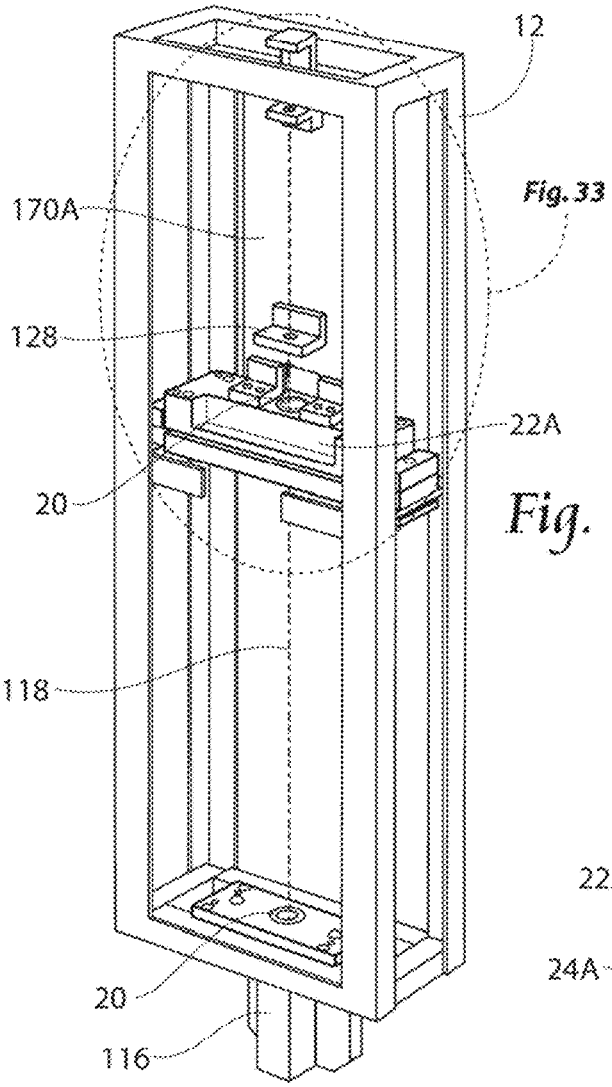
FIG. 32 is a perspective view of weight stack frame and showing an alternative alignment tool on an upper bearing block and laser attached to a lower block.
Figure 33:
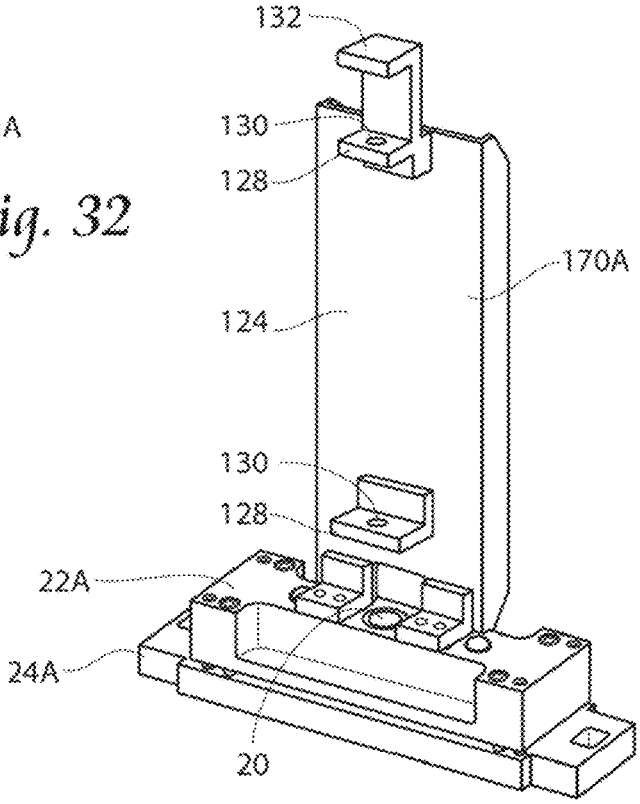
FIG. 33 is an enlarged view of the laser alignment tool referenced generally as FIG. 33 in FIG. 32.

An alternative laser upper alignment tool 170A may be seen in FIGS. 32 and 33. Here the tool 170A includes an upstanding member 124 that is secured to the upper bearing block 22A by way of the angled flanges 126 shown. The upstanding member 124 further includes at least one laterally extending flange 128 having a laser aperture 130 therein. Alignment is confirmed when the laser apertures 130 permit the laser beam 118 to pass and strike target 132.

Height Adjustment System

Figure 34:
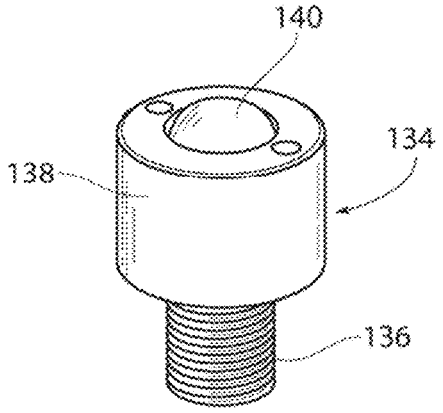
FIG. 34 is a perspective view of a weight stack height adjustment mechanism.
Figure 35:
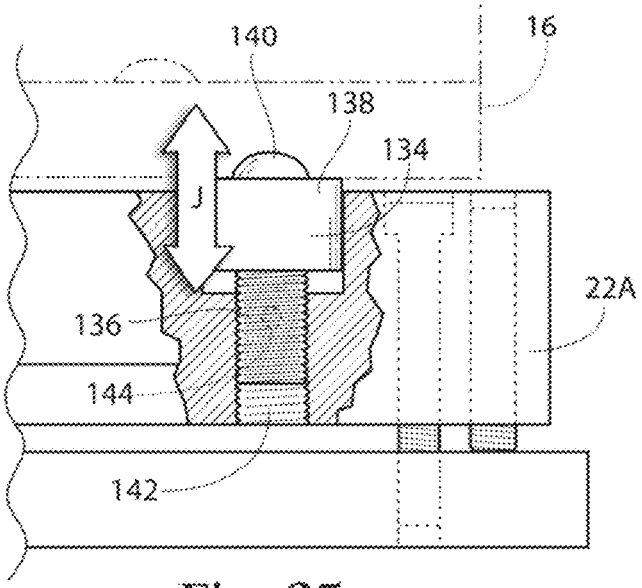
FIG. 35 is a fragmentary cut away view showing the adjustment mechanism illustrated in FIG. 34 mounted in an upper bearing block.

With reference now to FIGS. 34 and 35, weight stack adjusters 134 may be seen. The weight stack adjusters 134 serve to balance and level the weight stack 16, 18 for optimal performance in use. They also provide the ability to perfectly lift the upper and lower stacks 16 and 18, respectively, at one time. As shown, the weight stack adjuster 134 includes a threaded stem portion 136, a cylindrical collar portion 138 and a ball member 140 seated within the collar portion 138. With reference to FIG. 35, the stack adjuster 134 is seen mounted in the upper bearing block 22A in a threaded bore 142. The stack adjuster 134 may be rotated in the threaded bore 142 to thereby move the adjuster 134 in the direction of arrow J. Once the stack 16 is leveled, the adjuster 134 is fixed in place by the set screw 144, by way of non-limiting example.

Top Stack Modifications

The present invention further contemplates improvements to the upper weight stack 16 and the individual weight plates 150 that comprise the stack 16, as FIG. 36-42 illustrate.

Figure 36:
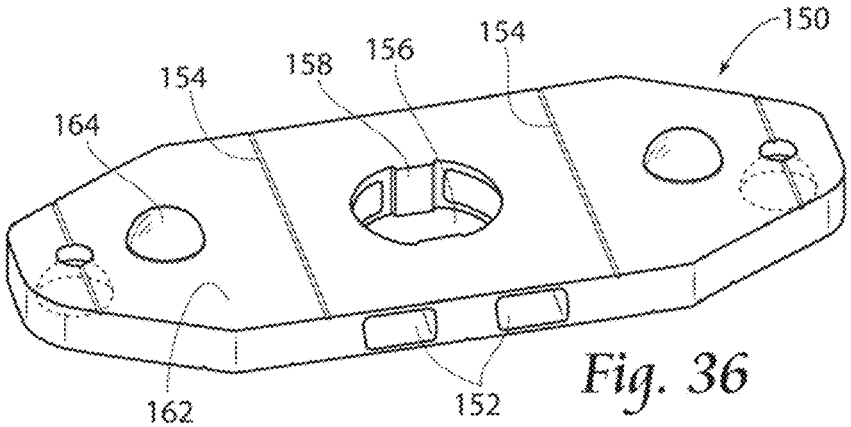
FIG. 36 is a perspective view of an upper stack plate and showing a double pin slot and alignment domes.
Figure 37:
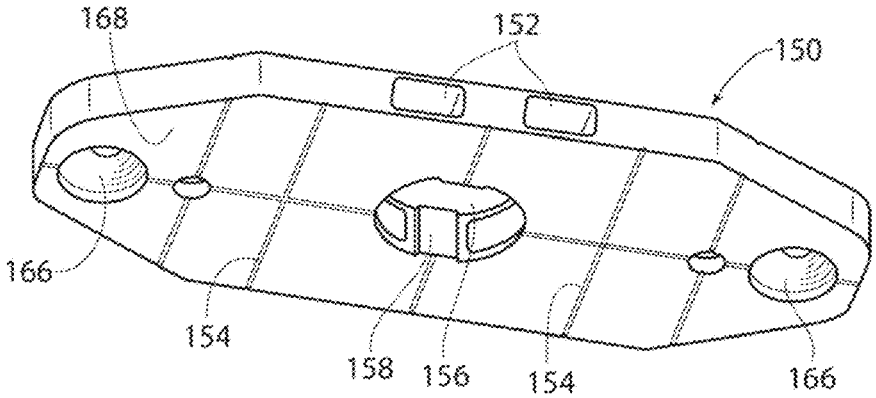
FIG. 37 is a bottom perspective view of the plate illustrated in FIG. 36 and showing cut lines.
Figure 43A:
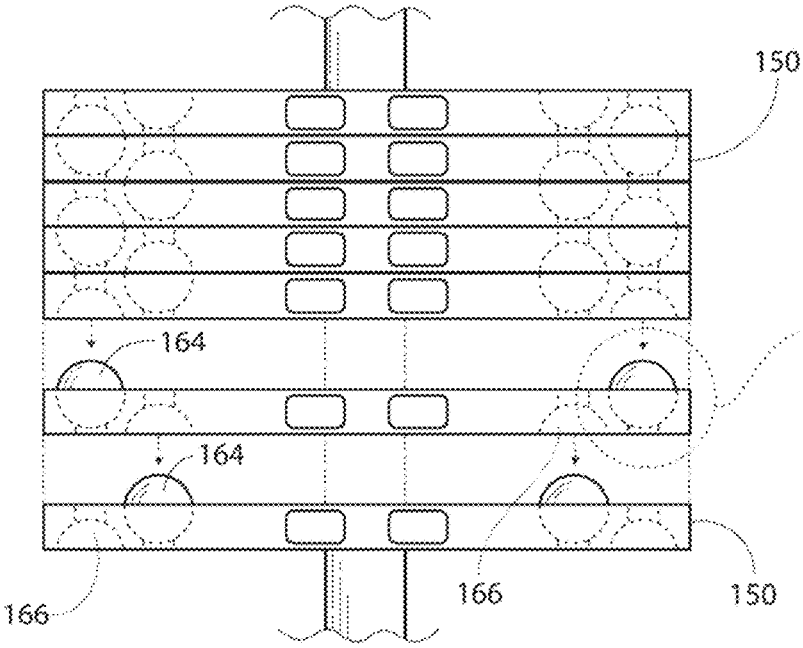
FIG. 43A is a fragmentary view of an upper weight stack and showing offset alignment domes.
Figure 43B:
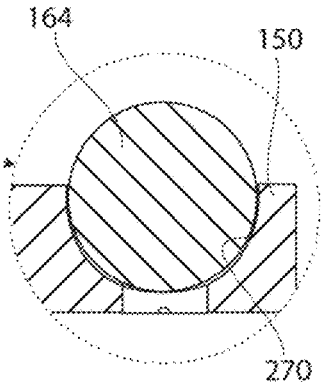
FIG. 43B is an enlarged section view showing an alignment dome seated in a mating cavity.

With specific reference to FIGS. 36 and 37, a weight plate 150 according to the present invention may be seen. The weight plate 150 includes a pair of pin slots 152, laterally spaced cut lines 154 and a central lift hole 156. As shown, the lift hole 156 includes an inwardly extending protrusion 158. The inwardly extending protrusion 158 assists in maintaining a secure fit with the lift rod 14. In known weight systems 200 the weight stack may shift relative the lift rod 14 as the selector pin is inserted and removed. The protrusions 158 also keep the plate 150 level and positioned properly and limit movement when the selector pin 160 (see FIG. 38) is inserted and removed. As may be further seen, the top surface 162 of the plate 150 may include at least one alignment dome 164. The alignment dome 164 is adapted to fit securely within a corresponding indentation 166 in the bottom surface 168 of an adjacent plate 150. The alignment domes 164 are preferably offset from one another in adjacent plates 150 to provide additional stability and help decrease the overall thickness of individual plates 150 (See particularly FIG. 43A) and may also allow for the use of larger alignment domes 164. As may be seen in the enlarged view of FIG. 43B, the indentations 166 are machined having slightly perpendicular side walls 270 to thereby allow for a press fit of the alignment domes 164.

Figure 44:
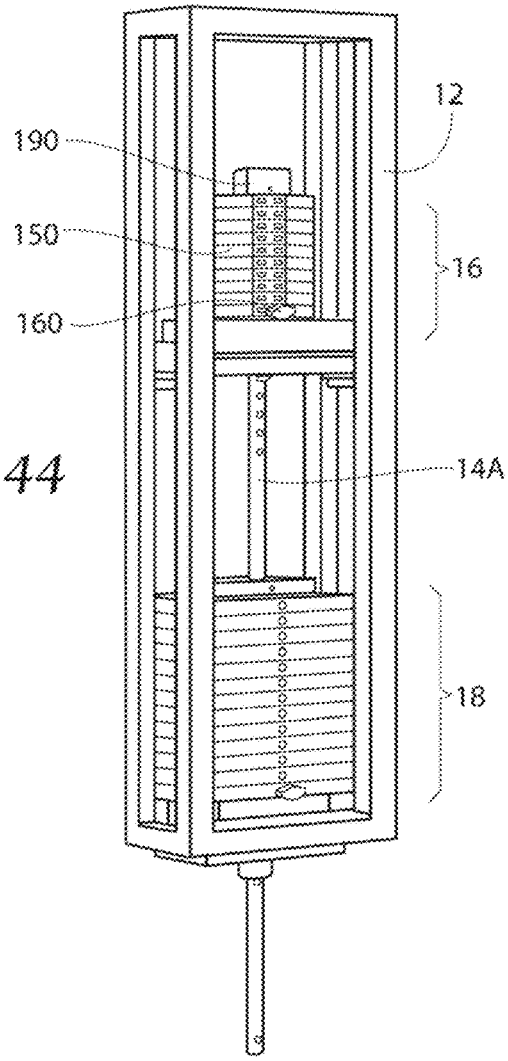
FIG. 44 is a perspective view of a weight frame and showing an upper and lower weight stack and modified lift rod having for use with plates shown in FIGS. 36 and 37.

The views of FIGS. 36 and 37 further illustrate laterally spaced cut lines 154. The cut lines 154 minimize metal-to-metal sticking of adjacent plates 150, thereby reducing any unaccounted for extra force required to lift the stack 16 while in use. A selector pin 160 for use with the plates 150 shown in FIGS. 36 and 37 may be viewed in FIG. 38. The selector pin 160 has a generally U-shape having a pair of arms 172 and a selector knob 174. The distal end 176 of each arm 172 may include a chamfered portion 178 to ease insertion into the pin slots 152. FIG. 44 depicts a weight frame 12 having an upper weight stack 16 utilizing the plates 150 and selector pin 160 discussed.

FIGS. 39 and 40 illustrate alternative weight plates 150A. As shown, the weight plates 150A include a single pin slot 152A. An alternative selector pin 160A for use with the weight plates 150A is seen in FIG. 41. As in the previously described weight plate 150, the weight plates 150A, of FIGS. 39 and 40 include laterally spaced cut lines 154 and a central lift hole 156 having an inwardly extending protrusion 158 to maintain a secure fit with the lift rod 14. The weight plates 150A include at least one alignment dome 164 extending from the top surface 162 of the plate 150A which is adapted to fit securely within a corresponding indentation 166 (not seen in these views) in the bottom surface 168 of an adjacent plate 150A. The weight plate 150A shown in FIG. 39 includes a pin slot 152A that is limited by the protrusion 158, while the weight plate of FIG. 40 illustrates an alternative pin slot 152B that extends across the width of the plate 150A.

A selector pin 160A for use with the plates 150A shown in FIGS. 39 and 40 may be viewed in FIG. 41. As shown, the selector pin 160A has a generally U-shape having a pair of arms 172 and a selector grip 174. Each arm 172 is relatively flat for ease in sliding into the pin slot 152A or 152B.

FIG. 42 illustrates an upper weight stack 16 in raised position and showing the plate 150 modifications. Specifically, the pin arms 172 (not seen in this view) help keep the plates 150 perpendicular to the lift rod 14 and minimize any movement in the direction of arrows K, L.

Lift Rod Modifications

To accommodate the modified weight plates 150, 150A and linear bearing 20 described above, modification to the lift rod 14 is also contemplated, as FIGS. 45-50B illustrate.

Figure 45:
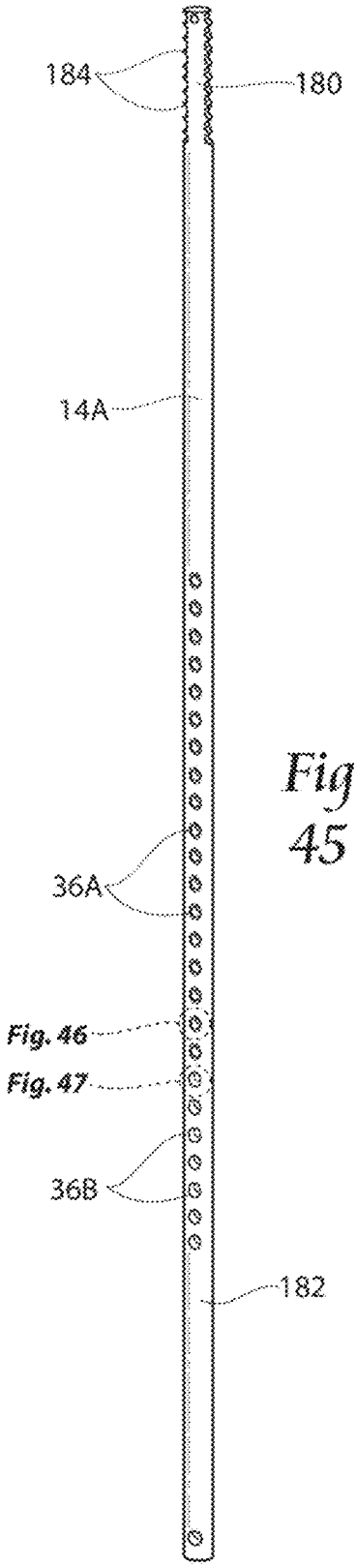
FIG. 45 is a perspective view of the lift rod shown in FIG. 44.
Figure 46:
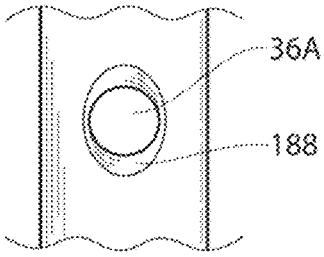
FIG. 46 is a fragmentary enlarged view of a lift rod hole and showing an oval chamfer.
Figure 47:
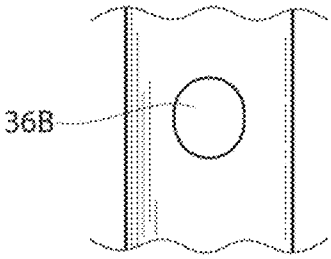
FIG. 47 is a fragmentary enlarged view of an elongated lift rod hole.
Figure 48:
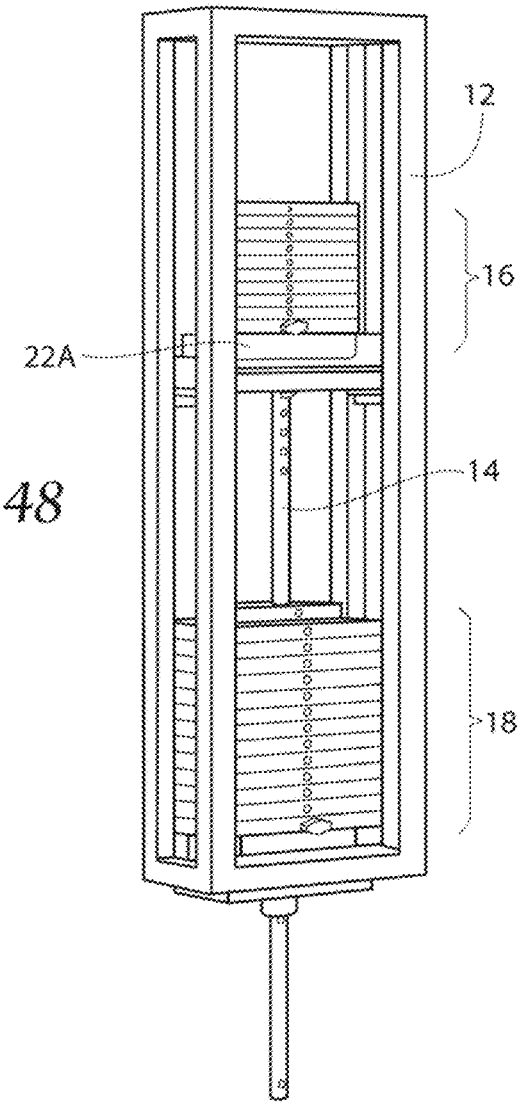
Figure 49:
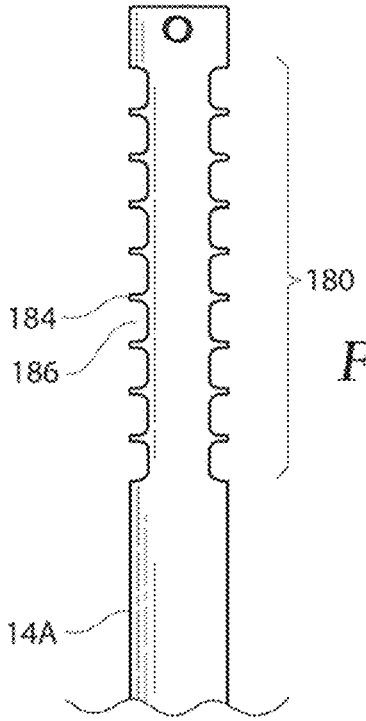
FIG. 49 is a fragmentary view of the lift rod illustrated in FIG. 45 and showing a toothed configuration for use with pronged weight selector pin.

A modified lift rod 14A embodying the features of the present invention may be seen in the view of FIG. 45. As shown, the rod 14A includes an upper section 180 and a lower section 182. The lower section 182 includes a plurality of modified lift rod holes 36A, 36B, while the upper section 180 includes two sets of ridges 184 having valleys 186 located therebetween (see also FIG. 49). The selector pin arms 172 (see FIG. 38 or 41) can be received within the respective valleys 186 to support the selected plate 150, 150A on the lift rod 14A. The enlarged fragmentary views of FIGS. 46 and 47 illustrate variation of lift hole 36A and 36B configuration. Specifically, FIG. 47 depicts a slightly elongated hole 36B for use in the lowest portion of the lift rod 14A. The holes 36B are elongated to prevent interference with the linear bearing raceways 34 (see FIG. 12), while FIG. 46 is a view of lift holes 36A used in the remainder of the lower section 182. The lift holes 36A of FIG. 46 are rounded as compared to those of FIG. 47 and further include an oval chamfered portion 188. The chamfered portion 188 assists in selector pin 194 placement.

Figure 50B:
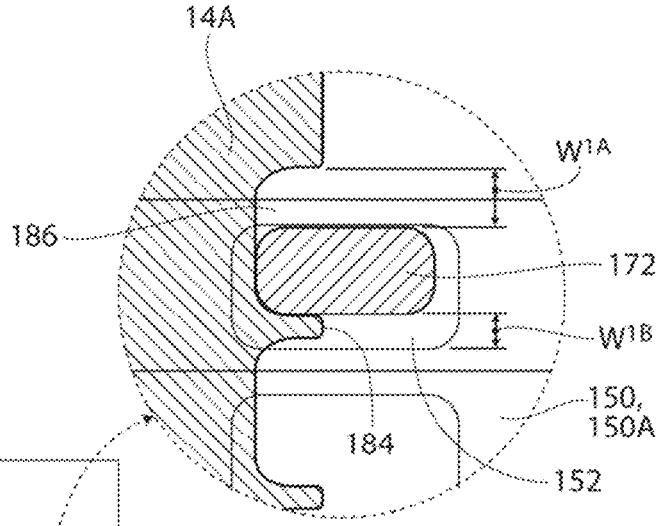
FIG. 50B is an enlarged view of the toothed rod and pin selector and illustrated in FIG. 50A but showing additional clearance for vertical movement of weight stack in upper weight stack.
Figure 50A:
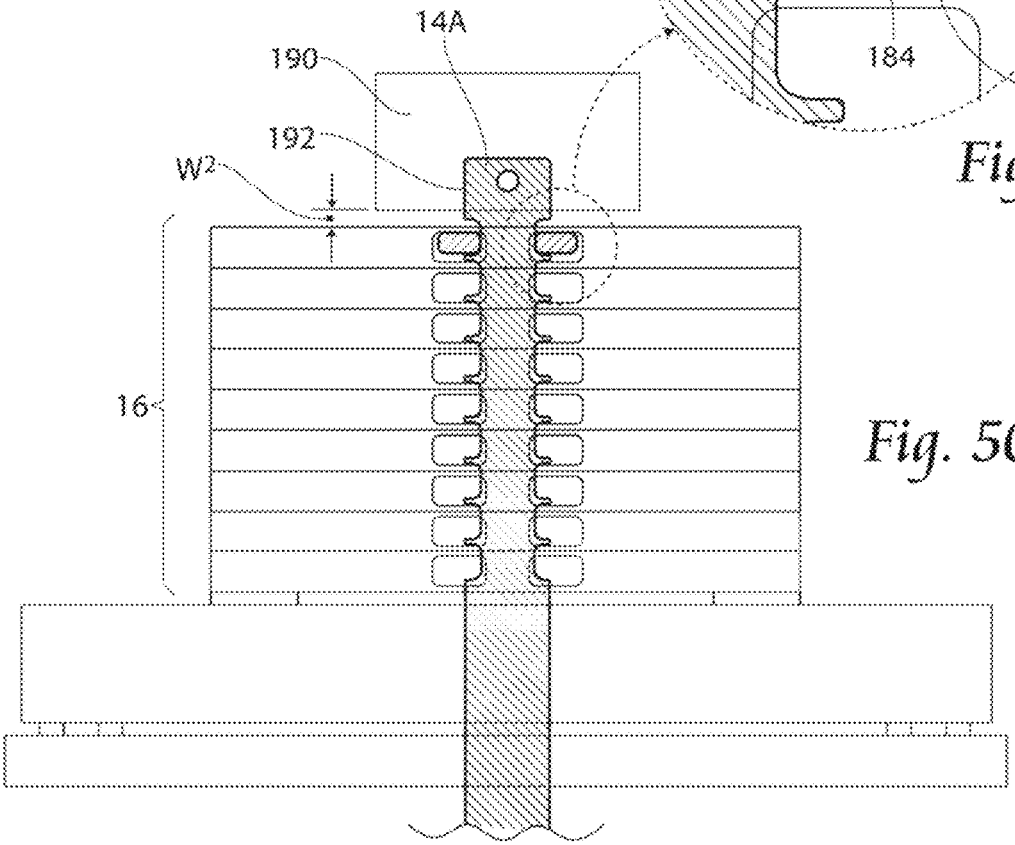
FIG. 50A is a fragmentary sectional view of an upper weight stack and toothed lift rod and showing a torpedo top plate.
Figure 51:
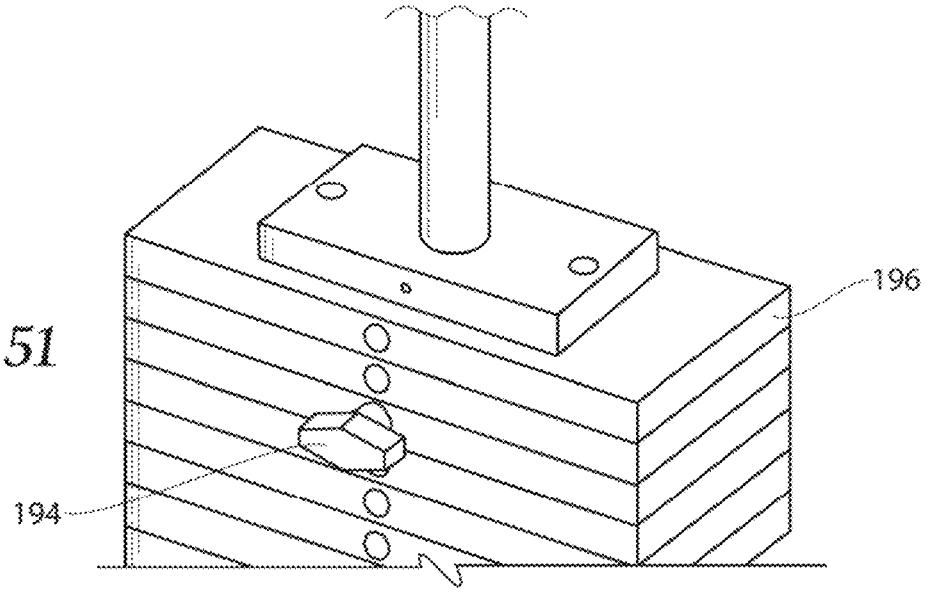
FIG. 51 is a fragmentary perspective view of a lower weight stack with selector pin in place.

As mentioned, lift rod 14A upper section 180 is preferably provided with two sets of ridges 184 having valleys 186 located therebetween. The arrangement of ridges 184 and valleys 186 is seen in detail in the views of FIGS. 49-50B. The selector pin arms 172 (see FIG. 38 or 41) can be received within the respective valleys 186 to support the selected plate 150, 150A on the lift rod 14A. The valleys 186 preferably have a width that is slightly greater that of the arms 172. With particular attention to FIGS. 50A and 50B, showing the pin arms 172 engaging the selected plate 150, 150A, the variation in relative width may be seen to provide a gap having a width $W^{1A}$ between the pin arm 172 and an adjacent ridge 184, a width $W^{1B}$ between the pin arm 172 and the pin slot 152 combining an overall width. As mentioned earlier, chamfers 178 on at the distal end 176 of the pin arms 172 allow the pin to be slid between a ridge 184 and a pin slot 152, 152A, 152B. Therefore, without width $W^{1A}$ there would be no distance between the pin arms 172 and an adjacent ridge 184. Furthermore, a torpedo plate 190 prevent damage to the upper portion 180 of the lift rod 14A upper weight stack 16 in the event of an unexpected drop in the weight stack 16 as explained below. The lift rod 14A may be provided with the torpedo plate 190 or a standard style top plate. The torpedo plate 190 is attached to the top 192 of the lift rod 14A adjacent the upper weight stack 16. As seen in FIG. 50A, the torpedo plate 190 is spaced from the upper weight stack 16 to form a gap having a width $W^2$. Width $W^2$ is slightly smaller than the combined widths of $W^{1A}$ and $W^{1B}$. In the event of an unexpected weight stack 16 drop, the selected plate 150, 150A will land on the plate in the weight stack 16 below the selected plate 150, 150A. The lift rod 14A will continue to fall relative the stack 16. Because width $W^2$ is less than the combined widths of $W^{1A}$ and $W^{1B}$, the torpedo plate 190 will make contact with the plate at the top of the stack 16 before the pin arms 172 make contact with the ridge 184 above them. Therefore, the torpedo plate 190 bears the impact, thereby preventing damage to the lift rod 14A.

Kick Plate

Figure 52:
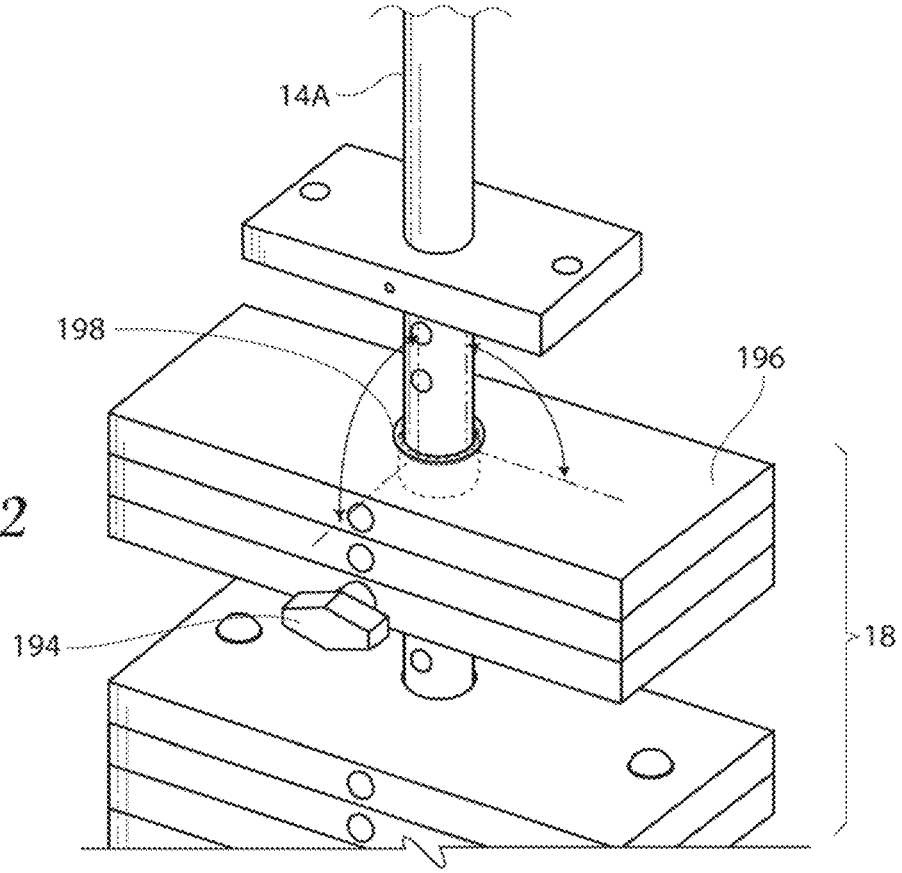
FIG. 52 is a fragmentary perspective view of a lower weight stack in raised, pinned position and showing a lift rod bushing.

Additional improvements to the weight system 10 are contemplated to assist the user in utilizing a weight lifting technique called "gapping" or "pinning". In this lifting style the user wishes to utilize only a selected portion of the total weight stack 16, 18 vertical distance. FIG. 52 illustrates the lower weight stack 18 used in this manner. As seen, the lift rod 14A is raised slightly and the selector pin 194 is inserted into a selected bottom plate 196. FIG. 52 further shows use of at least one bushing 198 to reduce friction on the lift rod 14A and to provide added stability. The bushing 198 also keeps a lifted portion of the stack 18 "square" (also important when only a single lift rod like 194 is used) and prevents the stack 18 from physically rocking while being lifted and set down. Furthermore, the bushing 198 helps to maintain stack 18 alignment with the lift rod 14A over time. The bushing 198 may be made of plastic by way of non-limiting example.

Figure 53:
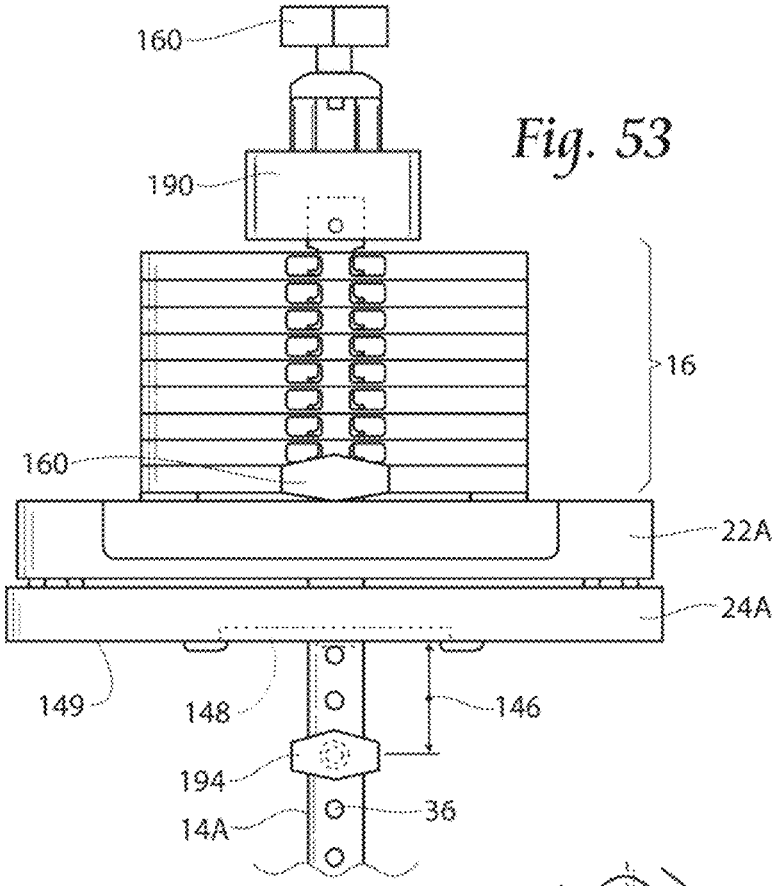
FIG. 53 is a fragmentary view of a lift rod with upper weight stack and showing a kick block and range limitation features.
Figure 55:
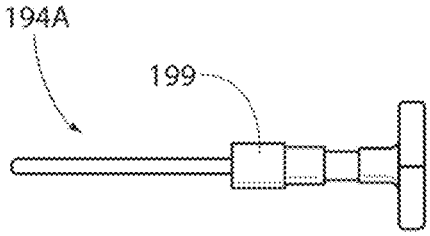
FIG. 55 is a side view of the selector pin illustrated in FIGS. 53 and 54.

FIG. 53 shows the upper weight stack 16 used in the gapping method. In this arrangement, the lift rod 14, 14A may include additional lift holes 36 to accommodate the extra selector pins 194 required for this technique. As seen, a first selector pin 194 is placed on the lift rod 14, 14A to produce the gap 146. A second, armed selector pin 160 is inserted in the selected plate 150 and a third selector pin 160 is stowed in the torpedo plate 190 for future use. The torpedo plate 190 is secured to the lift rod 14, 14A and further secures the top plates 150 to prevent removal from the system 10. The jack plate 24A is seen to include a kick block 148 for use with the gapping technique. The kick block 148 is positioned on the underside 149 of the jack plate 24A to receive the impact of the jack plate 24A as it contacts the first selector pin 194. The first selector pin 194 may be further modified (194A), as seen in FIG. 55, to include a sleeve portion 199. The sleeve portion 199 may be made of rubber or other dampening material, with the kick block 148 preferably fabricated or coated with a similar material.

Figure 54:
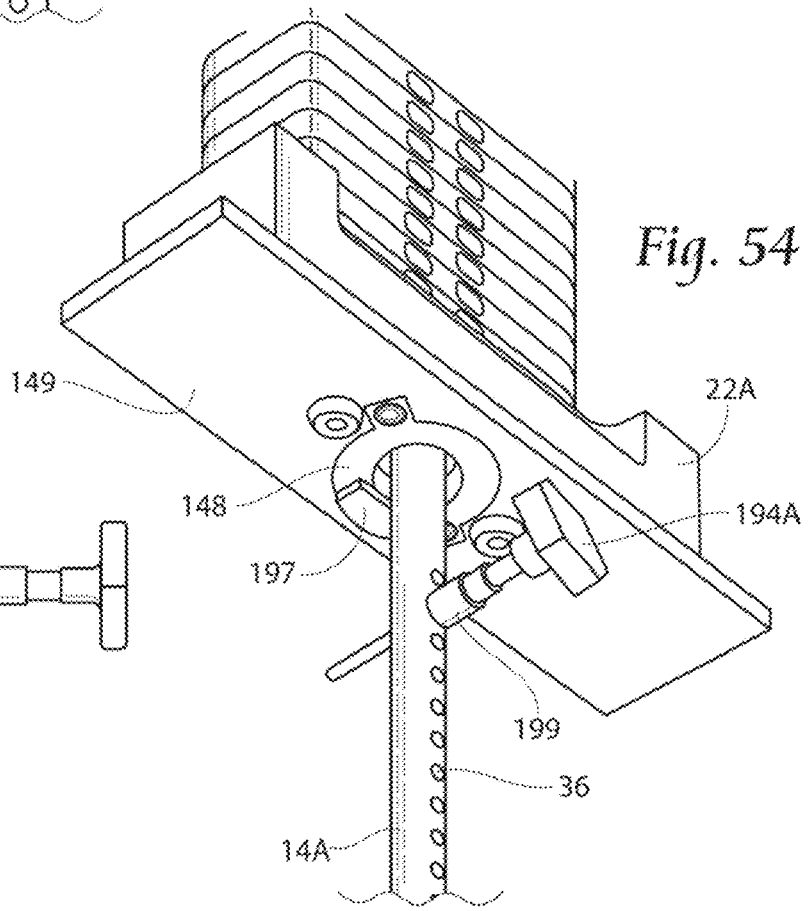
FIG. 54 is a bottom view of the combination illustrated in FIG. 53.

FIG. 54 illustrates a view of the kick block 148 on the upper jack plate 24A. The sleeve portion 199 of the pin 194A permits contact with the kick block 148 and not the jack plate 24A. The sleeve 199 also prevents a user from pushing the pin 194A in too far. If pushed in too far, the selector knob 174 would go under the jack plate 24A creating a pinch point. As seen, the kick block 148 includes a pad or bumper 197 made of rubber or other sound dampening material and used in a manner described with reference to FIG. 53. The bumper 197 effectively allows the kick block 148 to make contact with both sides of the pin 194A at the same time.

The foregoing is considered as illustrative only of the principles of the invention. Furthermore, since numerous modifications and changes will readily occur to those skilled in the art, it is net desired to limit the invention to the exact construction and operation shown and described. While the preferred embodiment has been described, the details may be changed without departing from the invention, which is defined by the claims.

I claim:

1. An adjustment system for aligning a weight stack in a weight training system, the adjustment system comprising:

a weight stack adjuster having a collar, a ball member partially housed within the collar, and a threaded stem portion extending from the collar;

a bearing block having a bore configured to receive the collar and the threaded stem portion of the weight stack adjuster;

the bore having a threaded portion configured to engage with the threaded stem portion of the weight stack adjuster;

a weight plate having an indentation configured to receive the ball member of the weight stack adjuster; and whereby the weight stack adjuster is adjustable into and out of the bore of the bearing block through the threaded engagement.

2. A method for aligning a stack of weights in a weight training system, the method comprising the steps of:

providing a weight stack adjuster having a collar, a ball member partially housed within the collar, and a threaded stem portion extending from the collar;

providing a bearing block having a bore within which the weight stack adjuster is received, the bore having a threaded portion;

engaging the threaded stem portion of the weight stack adjuster with the threaded portion of the bore;

providing a weight plate with an indentation configured to receive the ball member of the weight stack adjuster; and moving the weight stack adjuster into or out of the bore by rotating the weight stack adjuster relative to the bearing block.

* * * * *